US006566798B2

(12) United States Patent
Watanabe et al.

(10) Patent No.: US 6,566,798 B2
(45) Date of Patent: May 20, 2003

(54) CATHODE RAY TUBE WITH SUPPORTERS HAVING CRANK-SHAPED STEPS

(75) Inventors: Hirotoshi Watanabe, Osaka (JP); Masayuki Ohmori, Osaka (JP); Hideharu Ohmae, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/979,759

(22) PCT Filed: Jun. 1, 2001

(86) PCT No.: PCT/JP01/04665

§ 371 (c)(1),
(2), (4) Date: Nov. 14, 2001

(87) PCT Pub. No.: WO01/93299

PCT Pub. Date: Dec. 6, 2001

(65) Prior Publication Data

US 2002/0180329 A1 Dec. 5, 2002

(30) Foreign Application Priority Data

| | | |
|---|---|---|
| Jun. 1, 2000 | (JP) | 2000-164853 |
| Dec. 28, 2000 | (JP) | 2000-402872 |
| Mar. 30, 2001 | (JP) | 2001-100293 |

(51) Int. Cl.[7] ..... H01J 29/06
(52) U.S. Cl. ..... 313/407
(58) Field of Search ..... 313/402, 404, 313/407

(56) References Cited

U.S. PATENT DOCUMENTS

| | | | | | |
|---|---|---|---|---|---|
| 5,309,059 | A | * | 5/1994 | Kume et al. | 313/402 |
| 5,532,546 | A | * | 7/1996 | Horiuchi | 313/407 |
| 6,335,594 | B2 | * | 1/2002 | Park | 313/407 |
| 6,518,695 | B2 | * | 2/2003 | Lee | 313/407 |

FOREIGN PATENT DOCUMENTS

| | | | |
|---|---|---|---|
| JP | 8-273552 | 10/1996 | H01J/29/07 |
| JP | 11-317176 | 11/1999 | H01J/29/07 |
| JP | 2000-48735 | 2/2000 | H01J/29/07 |

* cited by examiner

*Primary Examiner*—Michael H. Day
(74) *Attorney, Agent, or Firm*—Merchant & Gould, P.C.

(57) ABSTRACT

A cathode ray tube includes a pair of plate members (7) facing each other, a pair of supporters (14) adhered to the respective plate members (7) to support the plate members (7), and a shadow mask (6) adhered to the respective plate members (7) while being applied with tensile force. The supporters (14) have crank-shaped steps (15) formed to protrude toward the shadow mask (6). Thereby, an internal moment of a shadow mask structure can be decreased, and thus, displacement of the shadow mask (6) in the axial direction is suppressed even when the shadow mask (6) is expanded by heat generated by impact of electron beams, and q-value deviation is suppressed as well. Moreover, since the crank-shaped steps (15) are helpful in blocking a transverse clearance with a ferrous material, the magnetic properties can be improved.

19 Claims, 18 Drawing Sheets

CATHODE RAY TUBE WITH SUPPORTERS HAVING CRANK-SHAPED STEPS

TECHNICAL FIELD

This invention relates to a shadow mask type cathode ray tube used for a television receiver, a computer display, and the like.

BACKGROUND ART

FIG. 18 is a cross-sectional view showing one example of a conventional color cathode ray tube. The color cathode ray tube 1 in FIG. 1 includes a substantially rectangular-shaped face panel 2 having a phosphor screen 2*a* formed on its inner surface, a funnel 3 connected to the rear side of the face panel 2, an electron gun 4 contained in a neck portion 3*a* of the funnel 3, a shadow mask 6 facing the phosphor screen 2*a* inside the face panel 2, and a mask frame 7 for fixing the shadow mask 6. Furthermore, in order to deflect and scan electron beams, a deflection yoke 5 is provided on the outer periphery of the funnel 3.

The shadow mask 6 plays the role of selecting colors with respect to three electron beams emitted from the electron gun 4. The shadow mask 6 is a flat plate in which a number of apertures, through which electron beams pass, are formed by etching. 'A' shows a track of the electron beams.

The frames 7 are plate members for fixing the shadow mask 6, and a pair of frames 8 to support the frames 7 are fixed to the longitudinal ends of the frames 7. The pair of frames 7 and the pair of frames 8 form a frame structure. This frame structure and a shadow mask 6 fixed to the frame structure compose a shadow mask structure 9.

Plate-shaped spring-attaching members 21 are adhered to the pair of top and bottom frames 7, and spring members 10 are fixed to these spring-attaching members 21. Plate-shaped spring-attaching members 11 are adhered to the pair of right and left frame 8, and spring members 12 are adhered to the spring-attaching members 11.

The shadow mask structure 9 is fixed to the face panel 2 by fitting attaching holes 10*a* of the spring members 10 with pins 13 provided to the top and bottom of the inner surface of the face panel 2, and by fitting the attaching holes 12*a* of the spring members 12 with pins (not shown) provided to the right and left of the inner surface of the face panel 2.

In a color cathode ray tube, due to the thermal expansion of the shadow mask 6 caused by the impact of the emitted electron beams, the apertures for passing electron beams are displaced. Consequently, a doming phenomenon occurs. That is, the electron beams passing through the apertures fail to hit a predetermined phosphor correctly, thus causing unevenness in colors. Therefore, a tensile force to absorb the thermal expansion due to the temperature rise of the shadow mask is applied in advance, and then the shadow mask 6 is stretched and held to the frames 7. When the shadow mask 6 is stretched and held as mentioned above, it is possible to reduce the displacement between an aperture of the shadow mask 6 and phosphor stripes of the phosphor screen 2*a* even if the temperature of the shadow mask 6 is raised.

However, the conventional color cathode ray tube described above suffered from the following problem. When an electron beam hits the stretched shadow mask 6, the shadow mask 6 is expanded by heat and reduces its tensile force. Thereby, the internal moment of the shadow mask structure 9 changes and the balance changes as well. Due to the change in the balanced state, a distance (q-value) between the apertures of the shadow mask 6 and the phosphor screen 2*a* is deviated, that is, the shadow mask 6 is displaced in the axial direction. This will prevent electron beams from hitting a desired position of the phosphor, which will lead to unevenness in colors.

Such color unevenness caused by the displacement of the shadow mask 6 in the axial direction cannot be prevented sufficiently even by stretching and holding the shadow mask as mentioned above.

DISCLOSURE OF INVENTION

It is an object of the present invention to provide a cathode ray tube that can solve the problems of conventional techniques. Such a cathode ray tube can suppress a shadow mask from being displaced in an axial direction and can prevent unevenness in colors.

To achieve the above object, a cathode ray tube of the present invention comprises a pair of plate members facing each other; a pair of supporters adhered to the respective plate members so as to support the plate members; and a shadow mask adhered to the respective plate members while being applied with a tensile force, and the supporters comprise crank-shaped steps formed to protrude toward the shadow mask. Since such a cathode ray tube can decrease an internal moment of the shadow mask structure, the displacement of the shadow mask in the axial direction can be suppressed and the q-value deviation also can be suppressed even if the shadow mask is expanded by heat generated by the impact of electron beams. Moreover, since the crank-shaped steps of the supporters serve to block a transverse gap with a ferrous material, the magnetic characteristics can be improved.

In the cathode ray tube, preferably, the supporters have portions extended from respective ends of the plate members in the longitudinal direction to the insides of the plate members, and the ends of the extended portions are adhered to the plate members so that the support members are adhered to the plate members at insides of the plate members in the longitudinal direction. Accordingly, the shadow mask will have a tensile force with a mountain-shaped distribution, so that vibration of the shadow mask can be suppressed easily at its free ends. Though the thermal expansion of the shadow mask will increase movement of the supporters, the stress is absorbed at parts insides of the plate members, and thus, stress applied to the axes of supporters to which the spring members are attached will be decreased. This provides further effects for decreasing an internal moment of the shadow mask structure.

Preferably, the supporters comprise spring-attaching members adhered to recesses at the crank-shaped steps so as to support the supporters, spring members are adhered to the spring-attaching members, attaching holes are formed in the spring members for accepting attaching pins, and the attaching holes have central points located opposing the shadow mask with respect to the supporters adhered to the plate members. A moment is applied to the support members due to the reaction force from shadow mask tensile force applied to the upper surfaces of the plate members. Since the above-mentioned cathode ray tube reduces the change in the moment, it can decrease the displacement of the upper surfaces of the plate members in the axial direction.

Preferably, the supporters comprise spring members adhered either at or outside the recesses at the crank-shaped steps so as to support the supporters, attaching holes are formed in the spring members for accepting attaching pins, and the attaching holes have central points located opposing the shadow mask with respect to the supporters adhered to the plate members. Such a cathode ray tube does not require any spring-attaching members since spring members are attached to the supporters directly.

Preferably, the crank-shaped steps have straight parts in the longitudinal direction of the supporters. In such a cathode ray tube, a member can be attached easily to the supporter, and the member is used for attaching a shadow mask structure comprising a shadow mask to a face panel.

Preferably, the crank-shaped steps have central axes at parts displaced toward the shadow mask, and the central axes are located above the shadow mask. Since the shadow mask gets closer to the phosphor screen due to thermal expansion of the shadow mask in such a cathode ray tube, unevenness in colors can be corrected.

Preferably, the crank-shaped steps have circular bent parts, and the inner radius of curvature at the circular bent parts is at least 20 mm. Such a cathode ray tube can prevent stress from being focused excessively at the bent parts, so that a sufficient rigidity can be maintained.

Preferably, support-adjusting members are adhered through the recesses at the crank-shaped steps, and the support-adjusting members are located facing the supporters. Such a cathode ray tube can not only decrease moment change but improve rigidity of the supporter. Since the cross-sectional second moment is increased, a rigid material used for the supporters can be decreased in size of the cross section. In addition, the displacement of the shadow mask in the axial direction can be suppressed further at a time of impact of emitted electron beams.

The supporter will have a cross-sectional second moment in the horizontal direction larger than a cross-sectional second moment about an axis in the axial direction. Therefore, the supporter is prevented substantially from being displaced in the axial direction while displacement in the horizontal direction is increased. Correction in the axial direction is available as well by using the horizontal displacement.

Preferably, the support-adjusting members comprise protrusions formed to lower spring constant of the support-adjusting members in the longitudinal direction. Accordingly, the support-adjusting member will relax the force in a direction for compressing the supporter at a time of operation of the cathode ray tube, and displacement of the shadow mask in the axial direction can be decreased.

Preferably, the spring constant of the support-adjusting members in the longitudinal direction is at most $1.47\times10^4$ N/mm.

Preferably, the support-adjusting members have a thermal expansion coefficient higher than that of the supporters. Accordingly, plastic deformation of the shadow mask can be prevented during heat treatment. Furthermore, displacement in the axial direction can be suppressed at a time of operation of the cathode ray tube.

Preferably, the support-adjusting members have a thermal expansion coefficient that is at least 1.2 times that of the supporters.

Preferably, support-adjusting members having a thermal expansion coefficient lower than a thermal expansion coefficient of the supporters are adhered to surfaces of the crank-shaped steps that are displaced toward the shadow mask. Such a cathode ray tube can prevent plastic deformation of the shadow mask during heat treatment.

Preferably, an internal magnetic shield is adhered to the support-adjusting members through an insulating material. Since such a cathode ray tube can suppress heat conduction from the supporters to the internal magnetic shield, and also suppress heat radiation effect of the internal magnetic shield, the supporters and the support-adjusting members can be kept stably at an identical temperature. Thereby, the movement amount of the electron beams can be stabilized and color displacement can be prevented.

Preferably, an internal magnetic shield is adhered to the support-adjusting members, and an area that the internal magnetic shield is contacted with the support-adjusting members is at most 25% of one surface of each of the support-adjusting members. Such a cathode ray tube in which the internal magnetic shield is contacted with the support-adjusting members at a small area can suppress thermal conduction from the supporters to the internal magnetic shield through the support-adjusting members, and also suppress heat radiation effect of the internal magnetic shield. Accordingly, the supporters and the support-adjusting members can be stabilized at the same temperature, and thus, the movement amount of the electron beams can be stabilized and color displacement can be prevented.

Preferably, the area that the internal magnetic shield is contacted with the support-adjusting members is at most 5% of one surface of each of the support-adjusting members. Such a cathode ray tube can suppress thermal conduction from the supporter to the internal magnetic shield through the support-adjusting members more reliably, so that color displacement can be prevented more certainly.

Preferably, an additional member is provided between the internal magnetic shield and the support-adjusting members, and the additional member has a thermal conductivity that is lower than that of the internal magnetic shield or of the support-adjusting members. Such a cathode ray tube can suppress thermal conduction from the supporters to the internal magnetic shield through the support-adjusting members with more certainty.

Preferably, the material of the additional member having a low thermal conductivity is SUS 304.

Preferably, the internal magnetic shield is connected with the support-adjusting members through a protrusion formed in at least either the internal magnetic shield or the support-adjusting members, and the contact area is equal to the connection area at the protrusion. Such a cathode ray tube can decrease the contact area between the internal magnetic shield and the support-adjusting members while connecting the internal magnetic shield and the support-adjusting members more easily and certainly.

BEST MODE FOR CARRYING OUT THE INVENTION

An embodiment of the present invention will be described below with reference to the drawings. Components that are common to the conventional techniques are identified with identical numerals.

First Embodiment

Figure 1:
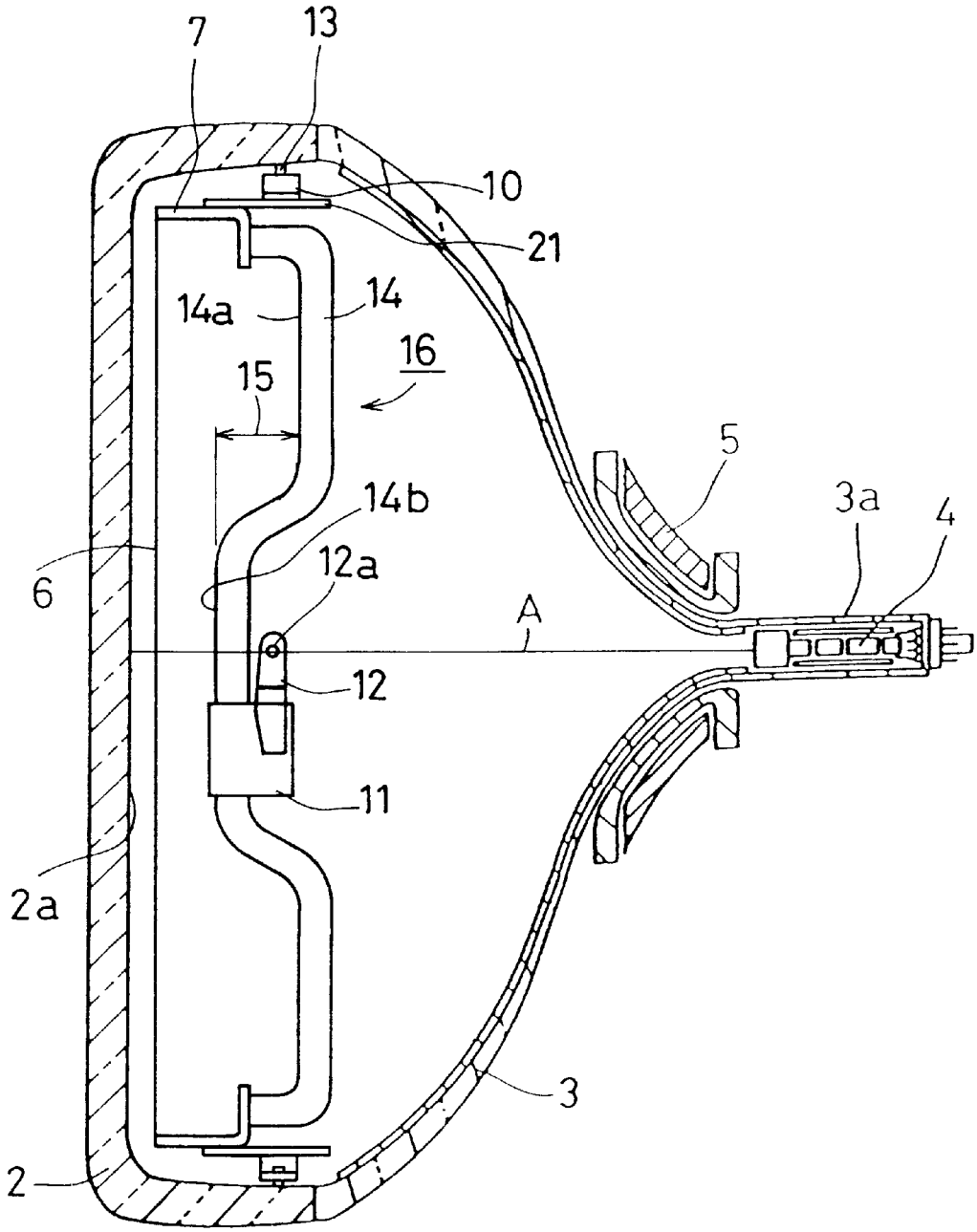
FIG. 1 is a cross-sectional view to show a color cathode ray tube in one embodiment of the present invention.
Figure 2:
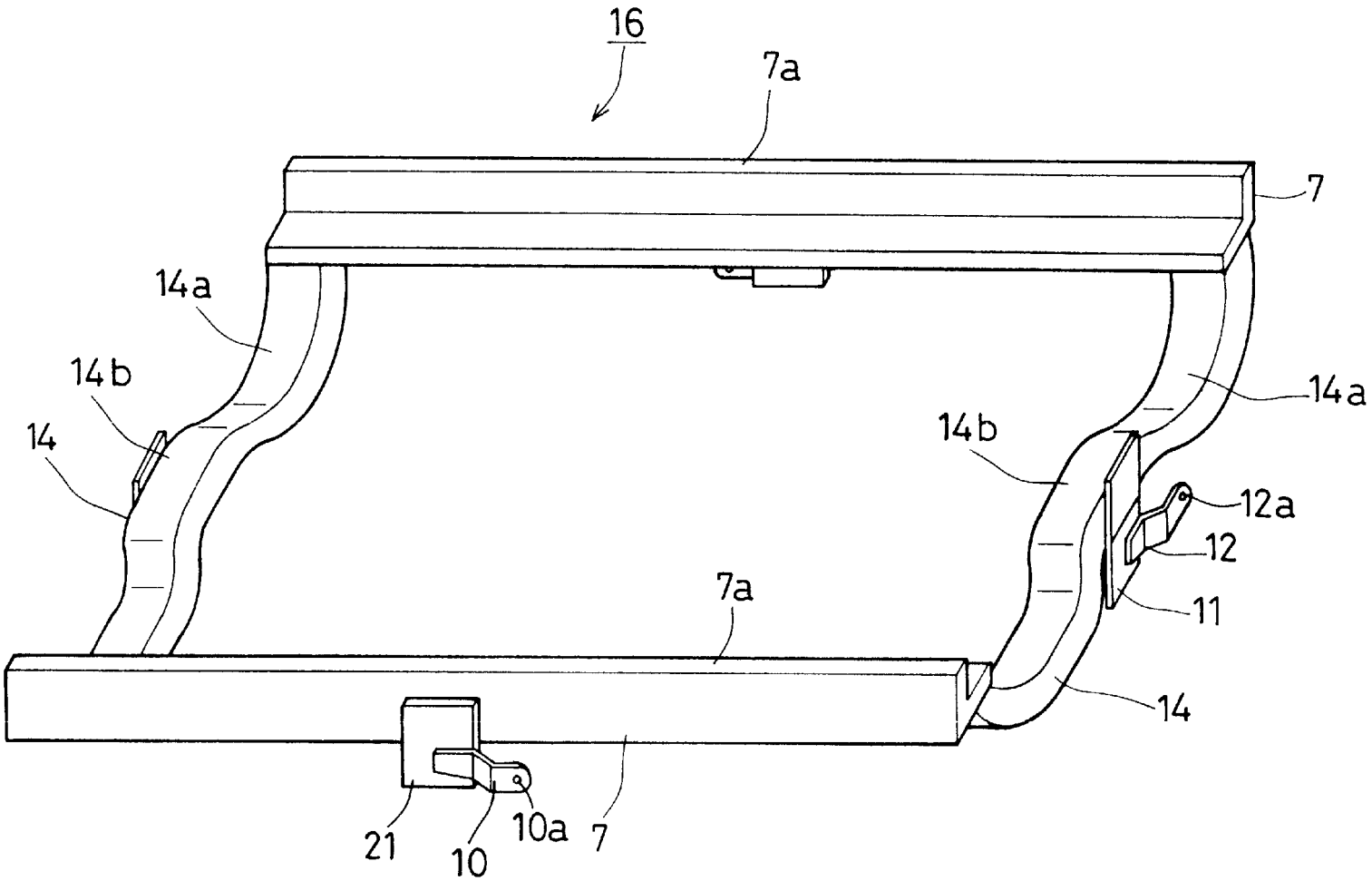
FIG. 2 is a perspective view of a shadow mask structure in a first embodiment of the present invention.

FIG. 1 is a cross-sectional view of a color cathode ray tube in a first embodiment of the present invention. FIG. 2 is a perspective view of a shadow mask structure 16 of FIG. 1. A shadow mask 6 is omitted from FIG. 2.

Plate-shaped frames 7 are supported by frames 14. Each of the frames 14 is bent to make a crank-shaped step. The frame 14 has surfaces 14*a* and 14*b*, and the surface 14*b* at the step is located closer to the shadow mask 6. A level difference 15 is provided between the surfaces 14*a* and 14*b*.

The right and left frames 14 are adhered respectively to the both ends of the top and bottom frames 7 by means of welding or the like in order to form a frame structure (FIG. 2). The shadow mask 6 is adhered to the upper surfaces of the frames 7 so as to form a shadow mask structure 16. Plate-shaped spring-attaching members 21 are adhered to the pair of top and bottom frames 7, and spring members 10 are fixed to the spring-attaching members 21. Plate-shaped spring-attaching members 11 are adhered to the pair of right and left frames 14, and spring members 12 are adhered to the spring-attaching members 11. Thereby, attaching holes 12*a* formed at the spring members 12 are located at the substantial centers of the respective frames 14 in the longitudinal direction. Since each of the surface 14*b* is formed along a straight line of the frame 14 in the longitudinal direction, the spring-attaching members 11 can be attached easily.

Figure 18:
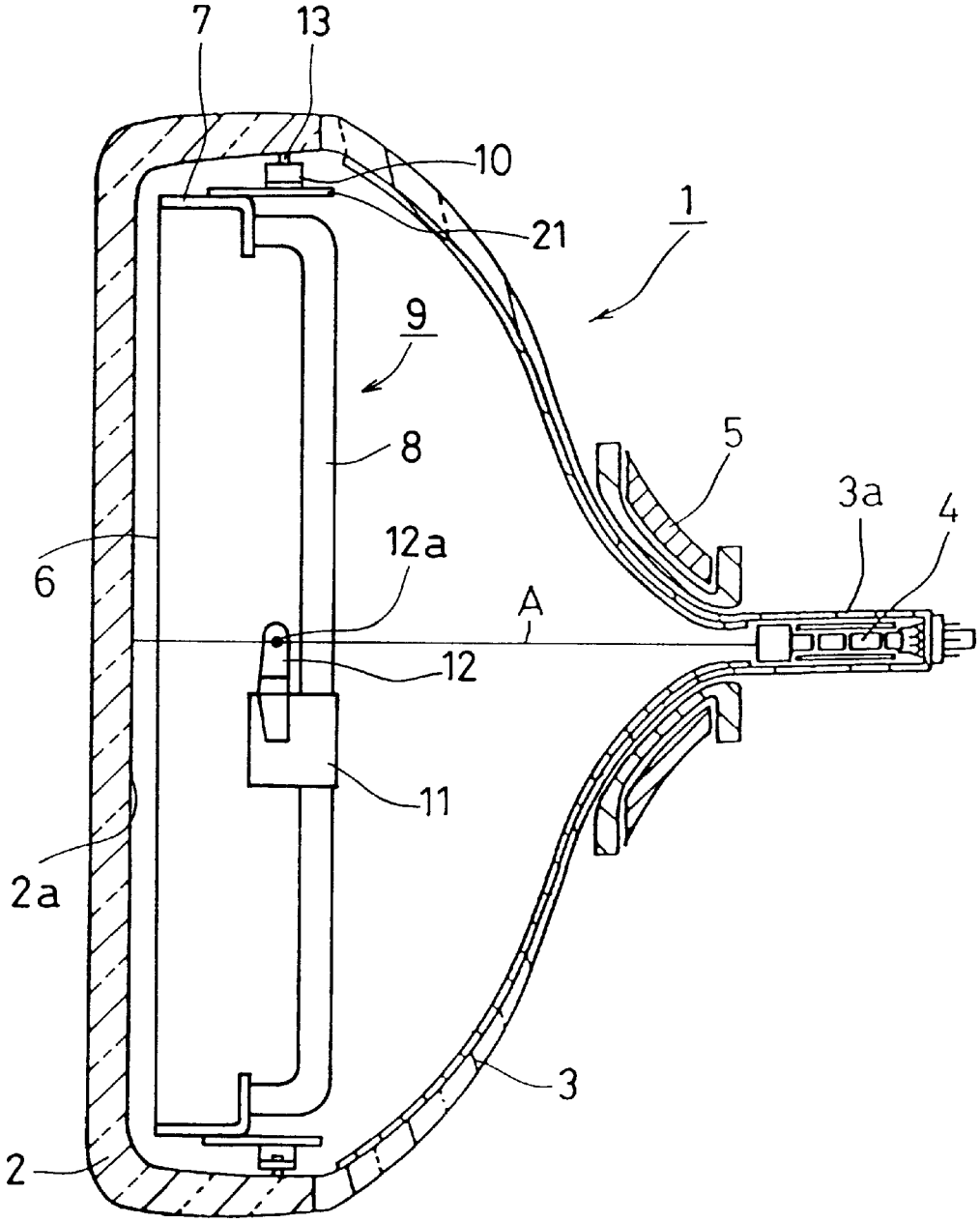
FIG. 18 is a cross-sectional view of a conventional color cathode ray tube.

The shadow mask structure 16 is fixed to the face panel 2 in the same manner as shown in FIG. 18, by fitting the attaching holes 10*a* of the spring members 10 with top and bottom pins 13 on the inner surface of the face panel 2, and by fitting the attaching holes 12*a* of the spring members 12 with right and left pins (not shown) on the inner surface of the face panel 2.

Figure 4A:
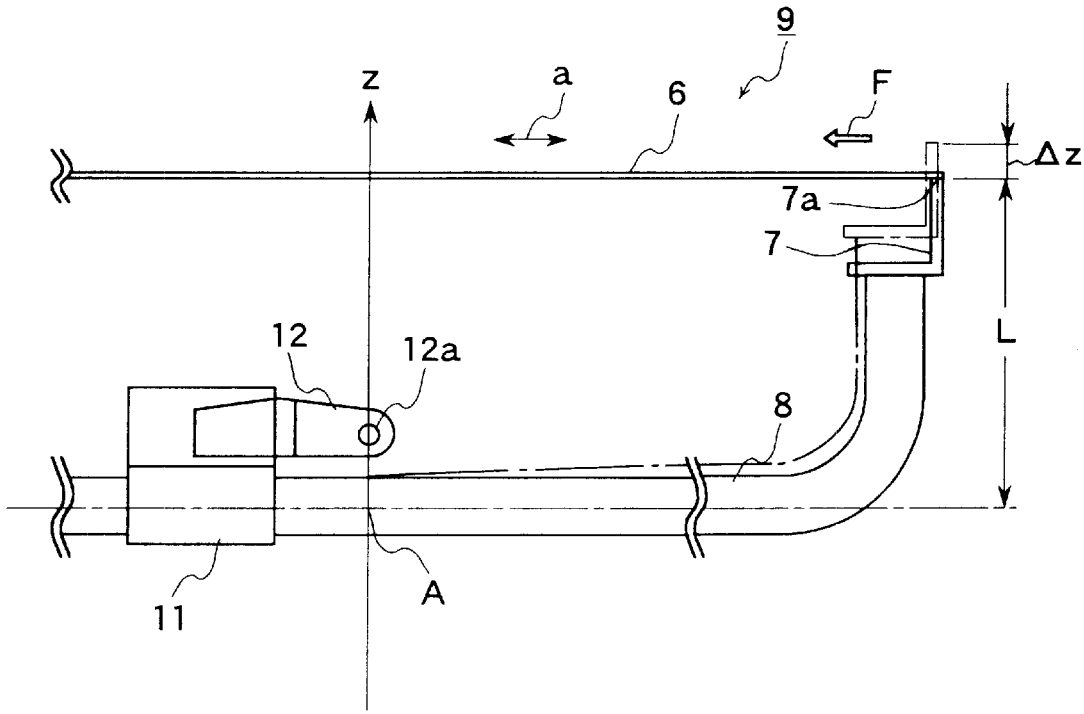
FIG. 4A illustrates a conventional shadow mask structure applied with a moment.
Figure 4B:
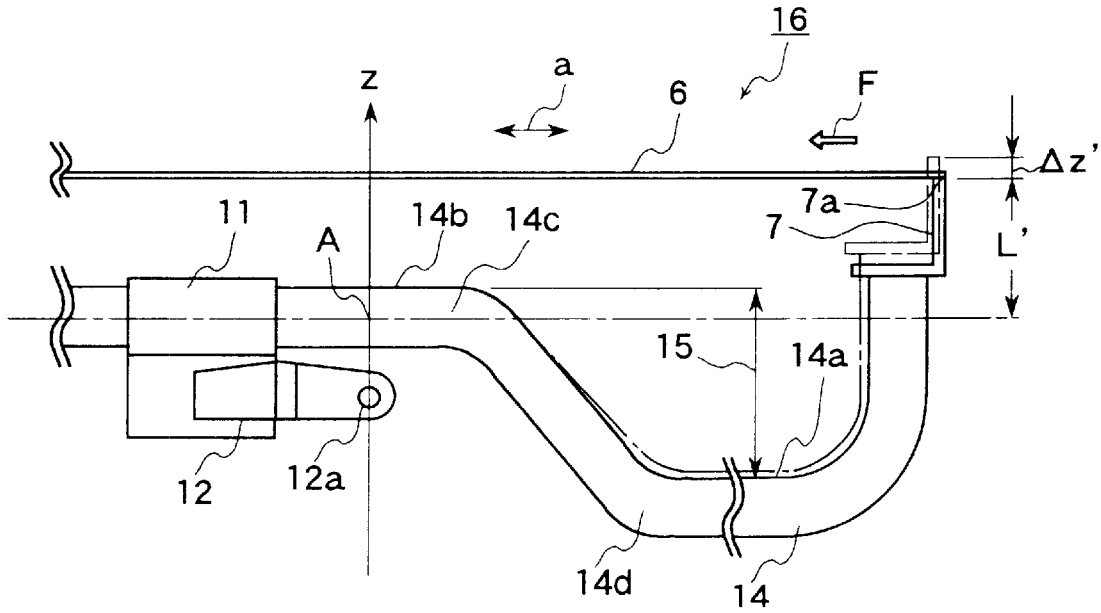
FIG. 4B illustrates a shadow mask structure in one embodiment of the present invention, where the shadow mask structure is applied with a moment.

FIGS. 4A and 4B are partial side views of shadow mask structures to show a comparison of moments applied to the respective shadow mask structures. FIG. 4A shows a shadow mask structure of a conventional technique according to FIG. 18, while FIG. 4B shows a structure of an embodiment shown in FIG. 1. In FIGS. 4A and 4B, z axis direction is equal to the axial direction and the upper regions in the drawings are determined to be a positive direction.

In any of FIGS. 4A and 4B, the shadow mask 6 is held in a state stretched over an upper surface 7*a* of the frame 7, so that the shadow mask 6 is applied with tensile force in a direction pointed with an arrow 'a'. When the shadow mask 6 has a tensile force F, the upper surface 7*a* of the frame 7 is applied with a reaction force F in a direction pointed with a thick arrow (a direction in which the upper surface 7*a* is tilted inward) and the reaction force F is as large as the tensile force F. The spring member 12 has a thickness of about 1 mm. A change in the moment, which is caused by thermal expansion in the shadow mask 6, will be determined depending on every frame assembled to be a frame structure.

In a conventional example shown in FIG. 4A, a relationship represented by $M=F\times L$ is established, where M denotes a moment provided by the reaction force F and moment M is about a point A as a center on the central axis of the frame 8, while L denotes a shortest direct distance from the upper surface 7*a* to the central axis. That is, in a condition as shown in FIG. 4A, the balance is kept in a state that a moment M about a point A, which is provided by the reaction force F of the upper surface 7*a* of the frame 7, is applied.

When the shadow mask 6 is expanded by heat and the tensile force F is decreased, the moment M about the point A provided by the reaction force of the upper surface 7*a* of the frame 7 is decreased as well, and this changes the balanced state. In a case of FIG. 4A, the tensile force F is lowered due to thermal expansion, and thus, the frame 8 shifts from a position indicated with the dashed line to a position indicated with a solid line, and the balance will be kept again in this state. That is, the upper surface 7*a* of the frame 7 is displaced by Δz in the negative direction of the z axis. Actually, since the frame 8 is bound by the attaching hole 12*a* of the spring member 12, the frame 8 is displaced by Δz in the negative direction of the z axis.

In FIG. 4B regarding an embodiment of the present invention, M'=F×L', where M' denotes a moment about a point A provided by the reaction force F, and L' denotes a shortest direct distance from the upper surface 7*a* to the central axis of the frame 14*c*. In this case, a surface 14*b* of the frame 14 is located in the positive direction of the z axis, i.e., at a position closer to the shadow mask 6 in a comparison between surfaces 14*a* and 14*b*. As a result, the point A also is displaced in the positive direction of the z axis. Therefore, the distance L' is shorter than the distance L by the distance of the level difference 15, and thus, relationships of L'<L and M'<M are established.

In FIG. 4B, the balance is kept in a state applied with a moment M' that is smaller than a moment M. When the shadow mask 6 is expanded by heat to reduce the tensile force F as in the case of FIG. 4A, the moment M' is reduced also and the balance will change. In FIG. 4B, due to the decline in the tensile force F, the frame shifts from a position indicated by a dashed line to a position indicated by a solid line, where the balanced state will be kept again. At this time, the bent frame 14 indicated with a dashed line moves to be relaxed. That is, as a result of thermal expansion, the upper surface 7*a* of the frame 7 is displaced by Δz' in the negative direction of the z axis.

The amount of displacement in the z axis direction caused by the change in the tensile force is in proportion to the moment about the point A provided by the reaction force on the upper surface of the frame 7, where the reaction force causes bending of the frame 14. Since M'<M as mentioned above, a relationship Δz'<Δz is established. Therefore, the moment about the point A caused by the reaction force of the upper surface 7*a* of the frame 7 can be reduced according to the present embodiment, the degree of the bending in the frame 14 can be decreased and the displacement amount of the upper surface 7*a* of the frame 7 in the z axis direction can be decreased as well. That is, even when the shadow mask 6 is expanded by heat generated by the impact of electron beams, displacement of the shadow mask 6 in the axial direction (z axis direction) can be suppressed and q-value deviation can be suppressed.

Figure 5:
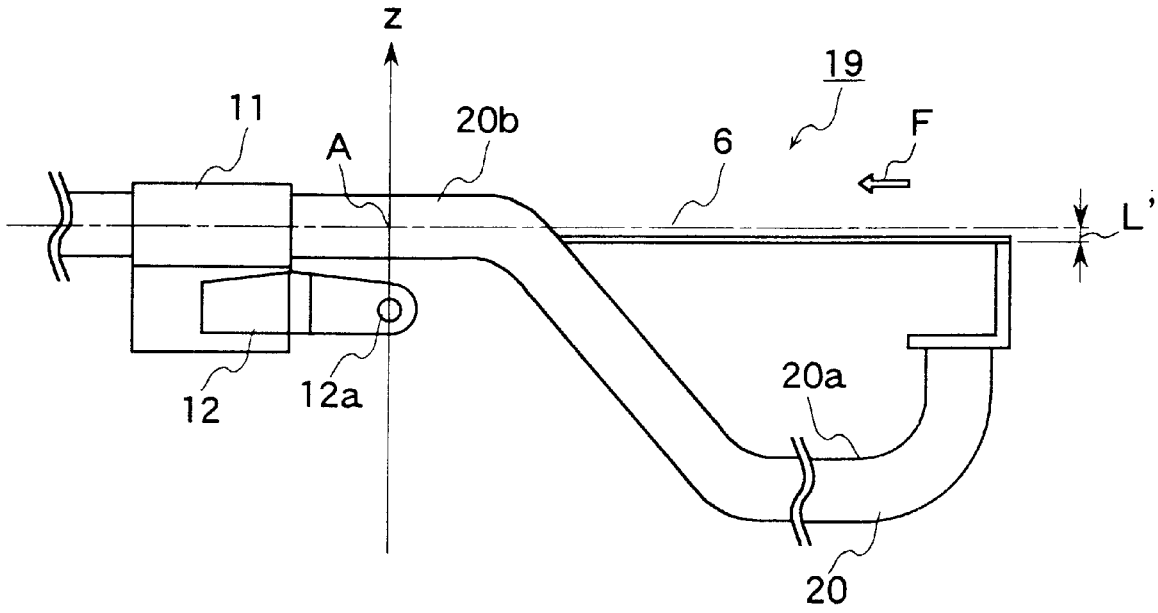
FIG. 5 illustrates a shadow mask structure in another embodiment of the present invention, where the shadow mask structure is applied with a moment.

In the embodiment shown in FIG. 4B, the surface 14*b* of the frame 14 is displaced in the positive direction of the z axis with respect to the surface 14*a*, while the surface 14*b* is located below a surface of the shadow mask 6. In an embodiment shown in FIG. 5, a level difference between surfaces 20*a* and 20*b* of a frame 20 is bigger when compared to a case of FIG. 4B. The surface 20*b* is displaced further in the positive direction of the z axis, and the surface 20*b* is located above the surface of the shadow mask 6.

In this embodiment, the point A as a center on the central axis of the frame 20 is located above the surface of the shadow mask 6 unlike the embodiment shown in FIG. 4B. Therefore, the moment M direction about the point A is reversed. As a result, the direction of displacement of the upper surface 7*a* of the frame 7, which is caused by thermal expansion in the shadow mask 6, is also reversed (positive direction of the z axis). Since the shadow mask 6 is displaced in the positive direction of the z axis, it will get closer to a phosphor screen surface 2*a*. This will provide an effect in correcting color displacement.

The frame 14 shown in FIG. 4B is applied with compression at a time of holding the shadow mask to be stretched, and thus, a moment about the point A will be applied as well after keeping the stretched state. Therefore, the frame 14 is required to have a certain rigidity to be resistant to plastic deformation. For satisfying the requirement, the circular bent parts 14*c* and 14*d* in the crank part are preferred to have an inner radius of curvature of at least 20 mm, and more preferably, at least 30 mm. The same condition can be used for the case of FIG. 5 and also an embodiment of FIG. 3 described below.

Second Embodiment

Figure 3:
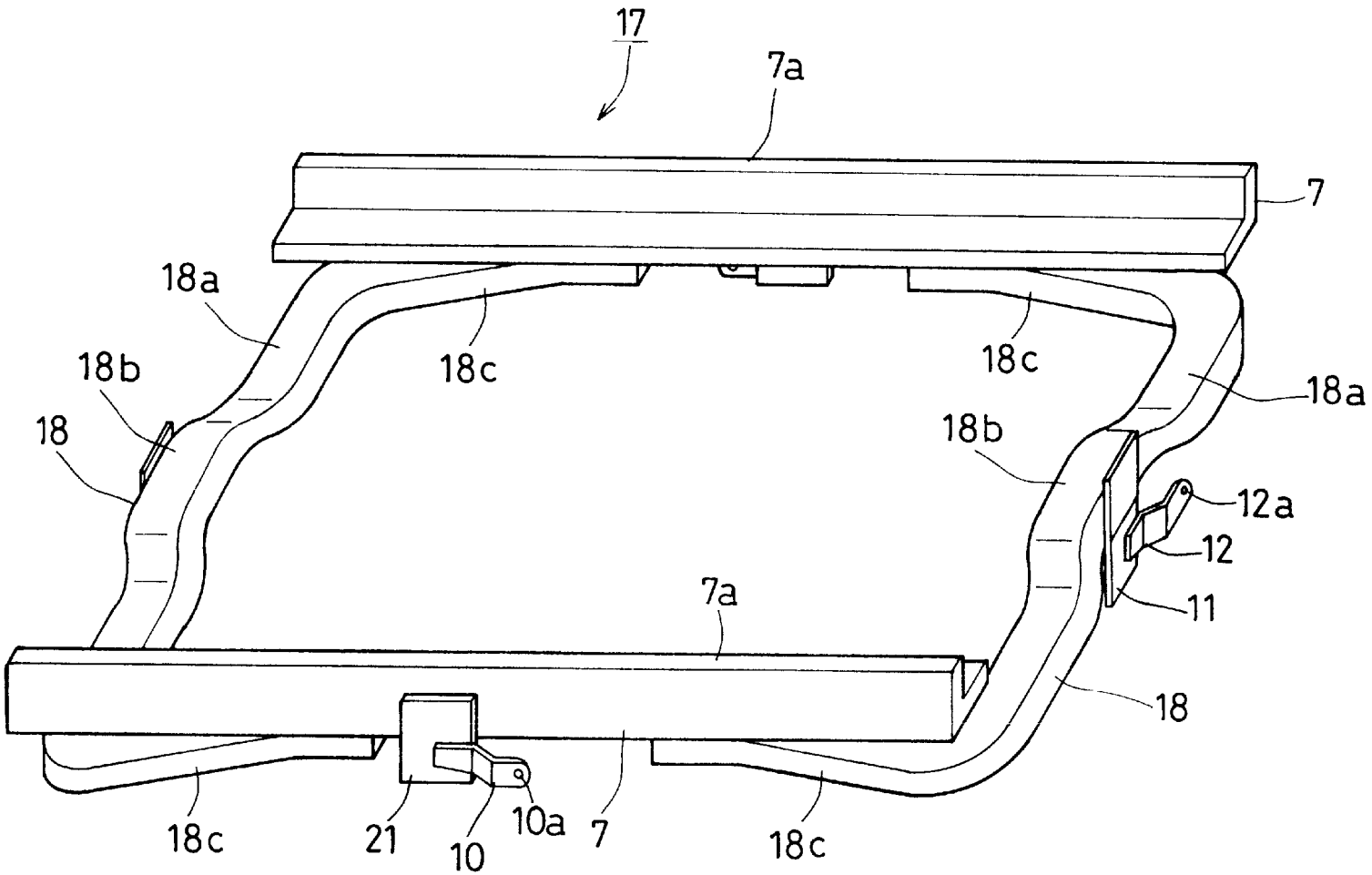
FIG. 3 is a perspective view of a shadow mask structure in a second embodiment of the present invention.

FIG. 3 shows a shadow mask structure according to a second embodiment. In FIG. 3, a shadow mask 6 is not shown. Similar to the frame structure shown in FIG. 2, a shadow mask structure 17 of FIG. 3 comprises plate-shaped frames 18 and frames 7 for supporting the frames 18. Each of the frames 18 has a bent part, and the bent part forms a crank-shaped step. The step has surfaces 18*a* and 18*b*, and the surface 18*b* is located closer to the shadow mask 6, and there is a level difference between the surfaces 18*a* and 18*b*.

Frames 18 have portions 18*c* extended from both ends to the insides of the frames 7 in the longitudinal direction. The extended portions 18*c* are adhered at the ends to the frames 7, so that the ends of the extended portions 18*c* reach the insides of the frames 7 in the longitudinal direction so as to be adhered by welding or the like. Therefore, there are gaps between the frames 7 and the frames 18 as supporters at both ends of the frames 7.

Similar to the embodiment shown in FIG. 2, the frame structure shown in FIG. 3 can decrease a moment about the point A caused by the reaction force of the upper surface 7*a* of each frame 7, and decrease bending and deformation of the frames 18. Even when the shadow mask 6 is expanded by heat, it is possible to suppress displacement of the shadow mask 6 in the axial direction, and also suppress q-value deviation.

By using the shadow mask structure 17 as shown in FIG. 3, the tensile force of the shadow mask 6 in the longitudinal direction of the frames 7 can be distributed to form a mountain, so that vibration of the shadow mask can be suppressed easily at the free ends of the shadow mask. When thermal expansion in the shadow mask 6 decreases the tensile force, movement of the frames 18 as short axes is increased when compared to the case of the shadow mask structure 16 shown in FIG. 2. However, stress is absorbed at the extended portions 18*c* reaching insides the frames and this decreases stress applied onto the axes of the frames 18 to which spring members 12 are attached. Therefore, the shadow mask structure of this embodiment is more effective in decreasing the moment about the point A.

The following Tables 1 and 2 show the results of a test to compare the movement amount of electron beams at a time of irradiation of electron beams. The test was performed by using a shadow mask structure of FIG. 1 and a conventional shadow mask structure of FIG. 18.

TABLE 1

| | EW ends | Corners |
|---|---|---|
| Conventional structure shown in FIG. 18 | Outward 15 μm | Outward 20 μm |
| Claimed structure shown in FIG. 1 | Outward 5 μm | Outward 7 μm |

TABLE 2

| | EW ends | Corners |
|---|---|---|
| Conventional structure shown in FIG. 18 | Outward 200 μm | Outward 130 μm |
| Claimed structure shown in FIG. 1 | Outward 100 μm | Outward 90 μm |

Table 1 relates to a result of a test in which the entire shadow mask is irradiated with electron beams, while Table 2 relates to a result of a test in which the shadow mask is irradiated partially with electron beams. In the case of Table 2, electron beams are irradiated to the right and left ends of the shadow mask. In any of the shadow masks, the area irradiated with electron beams corresponds to ⅕ of the shadow mask.

In Tables 1 and 2, 'EW end' denotes the right and left ends of the shadow mask. The right end is an E end and the left end is a W end when viewed from the surface of the shadow mask. The term 'outward' means that the electron beams moved outward on the phosphor surface. In the Tables 1 and 2, amount of the electron beam was as follows: Ia=1650 μA.

Electron beams will move outward on the phosphor surface as the shadow mask is displaced further in the negative axial direction (a direction for leaving from the phosphor surface). In the test results shown in Tables 1 and 2, the outward movement amount of the electron beams is decreased remarkably. This indicates that displacement of the shadow mask in the axial direction is decreased remarkably.

Third Embodiment

Figure 6:
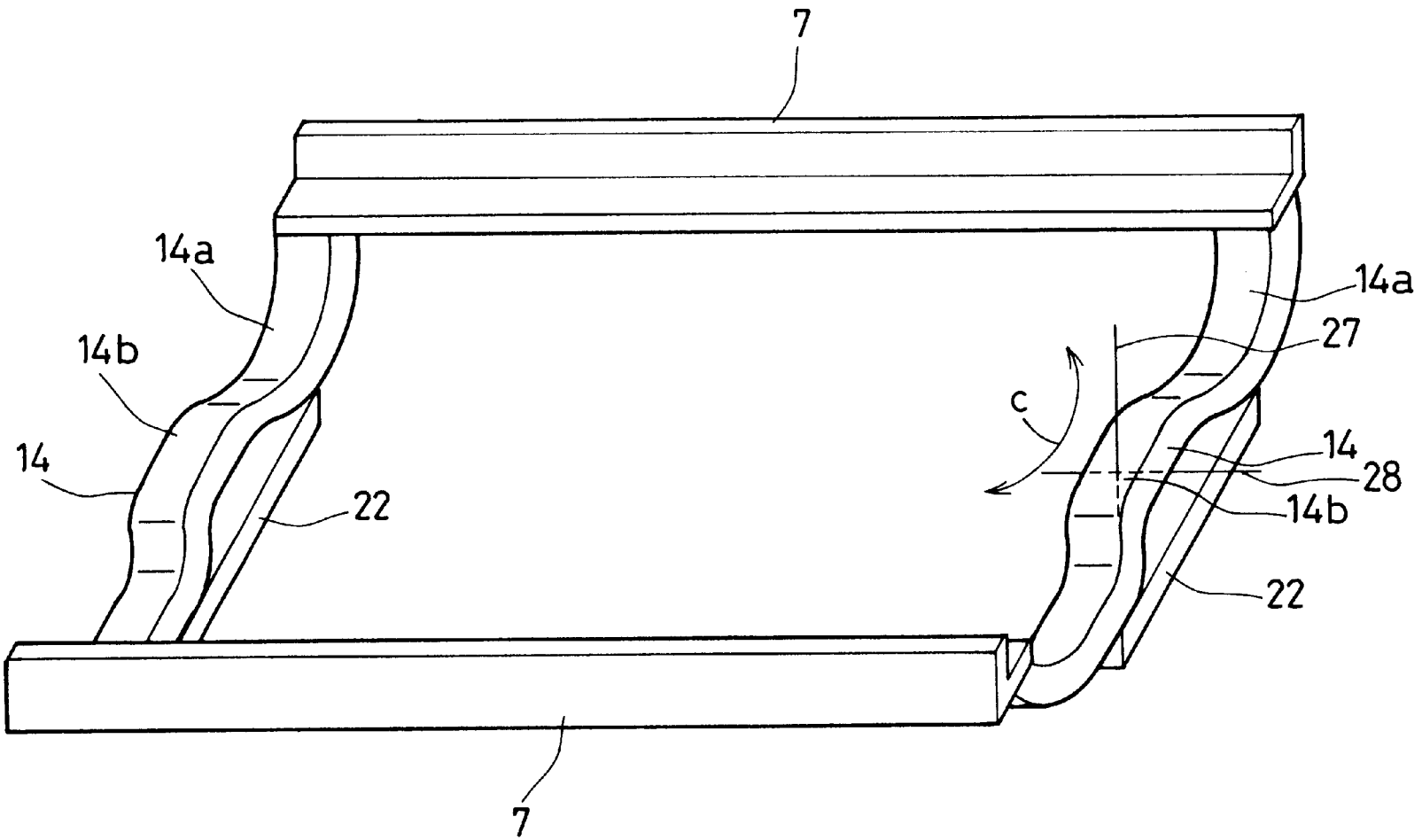
FIG. 6 is a perspective view of a shadow mask structure in a third embodiment of the present invention.

FIG. 6 is a perspective view to show a shadow mask structure according to a third embodiment. A shadow mask 6 is not shown in FIG. 6. The shadow mask structure is provided by adhering support-adjusting members 22 to the frames 14 shown in FIG. 2. The support-adjusting members 22 are arranged opposing the frames 14 through recesses at the crank-shaped steps of the frames 14. The support-adjusting members 22 are adhered at the ends to the backsides of the frames 14.

Such a structure improves the rigidity of the frames 14 as short axes and provides effects corresponding to the effects provided by frames having rectangular cross sections. Particularly, the cross-sectional second moment about a horizontal axis 28 is increased when compared to the cross-sectional second moment about the axial axis 27. Therefore, the frames 14 have improved strength with respect to bending in the longitudinal direction. In this embodiment, the moment change is decreased as in the embodiments shown in FIGS. 2 and 3, and the rigidity of the frames 14 is improved.

Therefore, this embodiment is effective further in suppressing displacement of the shadow mask in the axial direction, in which the displacement is caused by change in a moment of the short axes at a time of impact of electron beams. Moreover, since the improved rigidity serves to increase the cross-sectional second moment, the cross section of the steel material used for the supporters can be decreased.

For the frames 14, the cross-sectional second moment about the horizontal axis 28 is bigger than the cross-sectional second moment about the axial axis 27. Therefore, displacement of the frames 14 in the axial direction (axis 27 direction) is suppressed while displacement in the horizontal direction (axis 28 direction) is increased. When the frames 14 move outward in the horizontal direction, the frames 14 can be displaced in the axial direction by using plate-shaped springs fixed to the frames 14. That is, correction in the axial direction is available by using the horizontal displacement of the frames 14.

Fourth Embodiment

In a fourth embodiment, the support-adjusting members are made of a material having a thermal expansion coefficient higher than that of the short frames to which the support-adjusting members are adhered, so that further effects will be obtained. When the short frames are made of a ferrous material, the support-adjusting members are made of SUS 304 or the like.

This embodiment is effective in preventing plastic deformation of the shadow mask and decline in tensile force caused by a heat creeping phenomenon. Such inconvenience is caused since the shadow mask is stretched excessively by the short frames at a time of heat treatment in a high temperature region during a step of frit sealing or the like.

Under a high temperature condition, a tensile force caused by temperature rise is applied to the shadow mask. In the embodiment shown in FIG. 6, the tensile force will be decreased because of the difference in the thermal expansion coefficients between the short frames and the support-adjusting members. That is, the short frames 14 are bent to be concave as shown with arrows 'c', and the shadow mask is applied with force in a direction to relax the tensile force in the stretching direction.

Figure 7A:
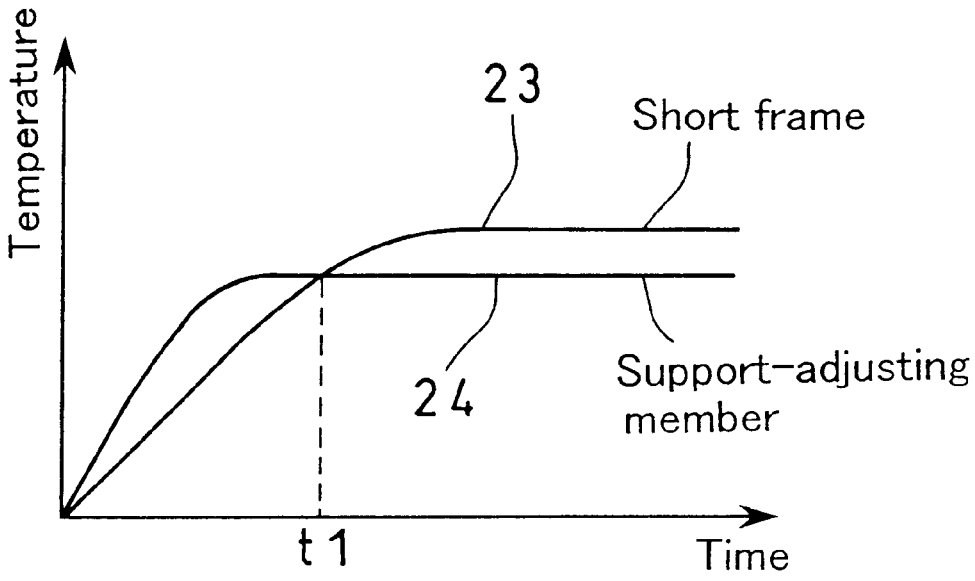
FIG. 7A is a graph to indicate a relationship between time and temperature concerning a frame and a support-adjusting member at a time of operation of a cathode ray tube.

As mentioned above, plastic deformation of a shadow mask in a high temperature region in a production process such as frit sealing can be prevented by using support-adjusting members having a thermal expansion coefficient higher than that of short frames. The difference in the thermal expansion coefficients will be helpful in suppressing the displacement in the axial direction at a time of operation of the cathode ray tube. The details are explained below by referring to FIGS. 7–12. FIG. 7A is a graph to show a relationship between time and temperature concerning a short frame and a support-adjusting member at a time of operation of a cathode ray tube. The line 23 denotes a relationship between time and temperature of a short frame, while the line 24 denotes a relationship between time and temperature of a support-adjusting member.

Figure 8:
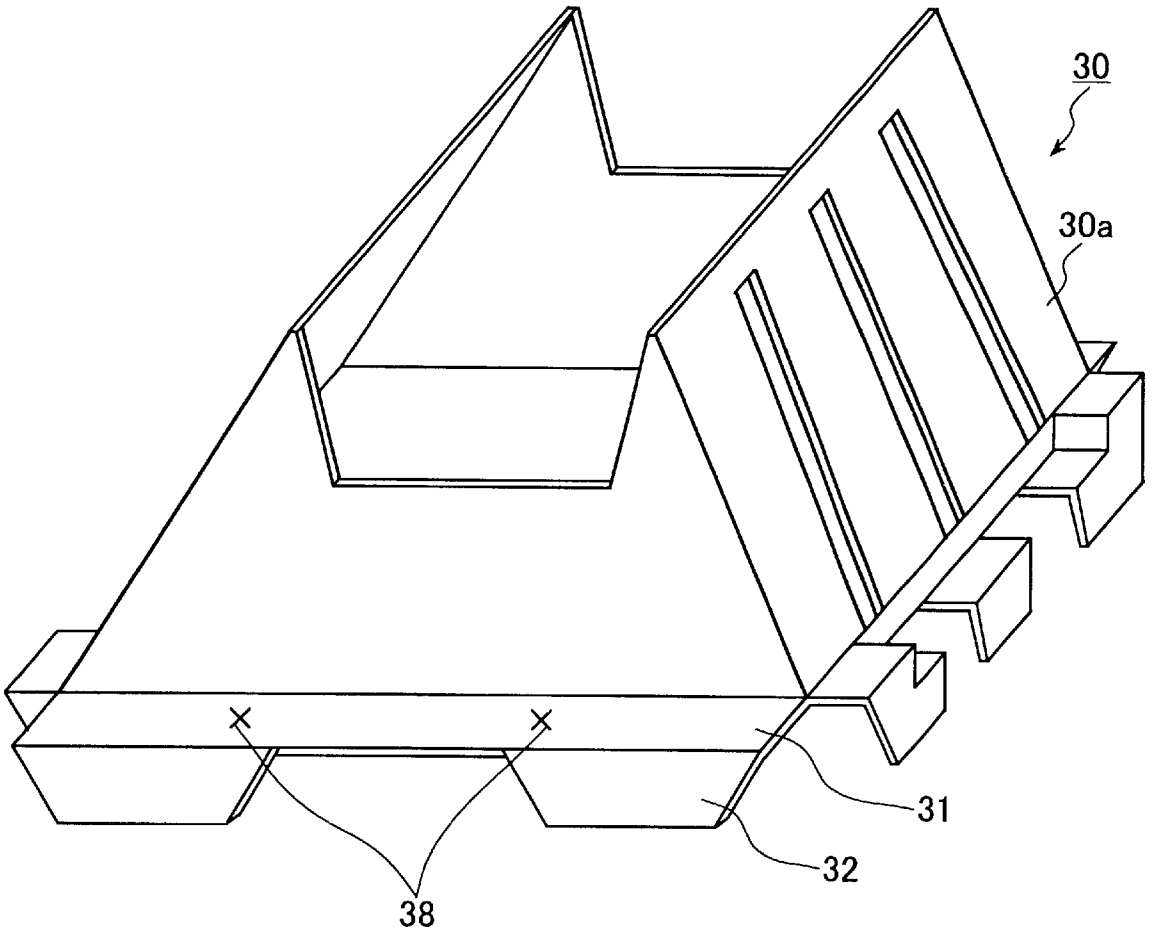
FIG. 8 is a perspective view to show one example of an internal magnetic shield.
Figure 9:
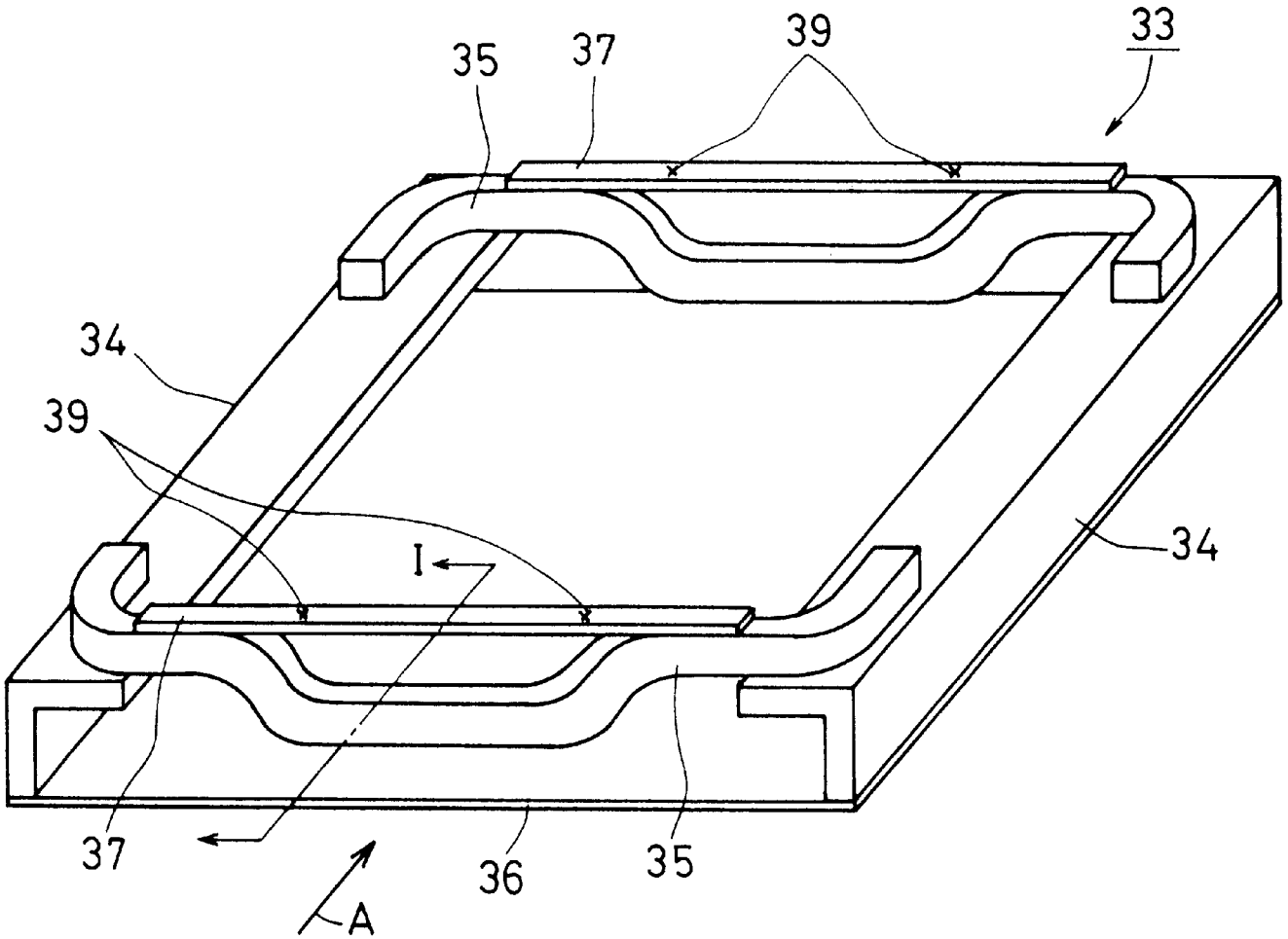
FIG. 9 is a perspective view of a shadow mask structure in a fourth embodiment of the present invention.

FIG. 8 is a perspective view to show an internal magnetic shield. An internal magnetic shield 30 shown in FIG. 8 comprises flat portions 31 extended from a body 30*a* to be welded and also skirt portions 32 formed by bending the flat portions 31. The body 30*a* is a box surrounding an electron beam path. FIG. 9 is a perspective view to show an embodiment of a shadow mask structure. A shadow mask structure 33 in FIG. 9 has a basic structure as shown in FIG. 6. Short frames 35 as supporters are adhered to long frames 34 as plate members. A shadow mask 36 is adhered to the respective long frames 34. Support-adjusting members 37 are adhered to the short frames 35.

In FIG. 9, the support-adjusting members 37 are arranged on the surface. The internal magnetic shield 30 in FIG. 8 is attached so that the skirt portions 32 cover the shadow mask structure 33. The flat portions 31 of the internal magnetic shield are welded to the support-adjusting members 37 of the shadow mask structure 33, so that the shadow mask structure 33 and the internal magnetic shield 30 are adhered to each other. For example, welding points 38 of the flat portion 31 in FIG. 8 and welding points 39 of the support-adjusting member 39 in FIG. 9 are lapped and welded to each other.

Figure 10:
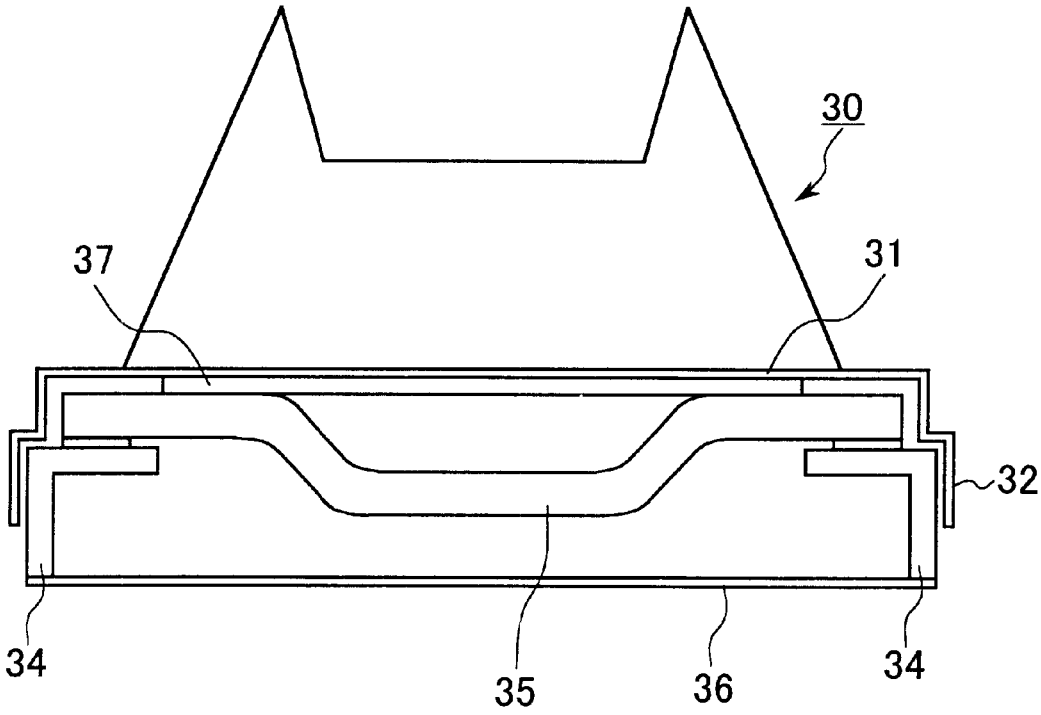
FIG. 10 is the shadow mask structure of FIG. 9 viewed from a direction pointed with an arrow A, in which the shadow mask structure is connected with an internal magnetic shield.
Figure 11:
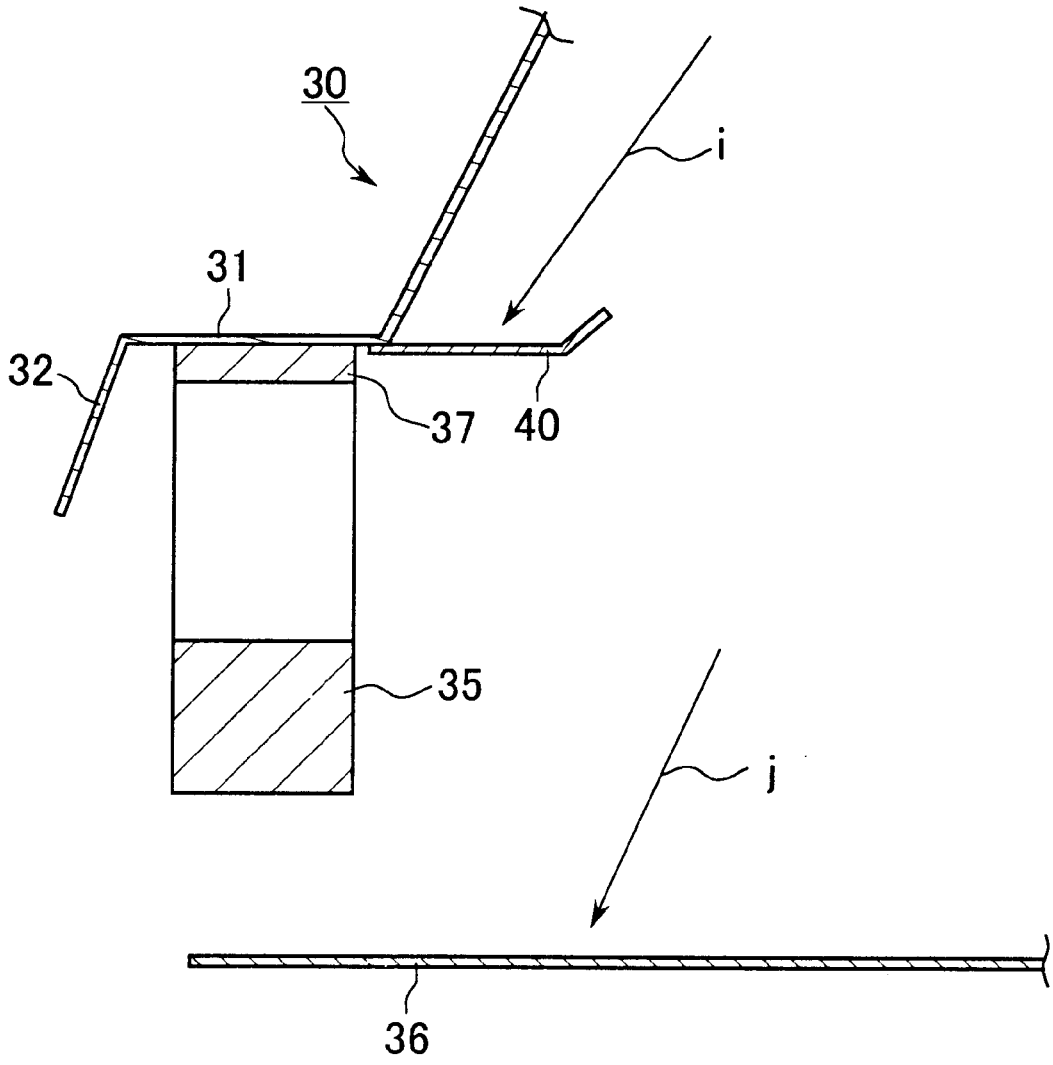
FIG. 11 is a cross-sectional view of the shadow mask structure of FIG. 9 taken along a line I—I, in which the shadow mask structure is connected with an internal magnetic shield.

FIG. 10 shows the internal magnetic shield 30 of FIG. 9, which is connected with a shadow mask structure 33 and viewed along an arrow A. The internal magnetic shield 30 and the shadow mask structure 33 are connected with each other. The skirt portions 32 are omitted partially from FIG. 10 in order to show that the flat portion 31 is connected with the support-adjusting member 37. FIG. 11 is a cross-sectional view of the same magnetic shield 30 connected with the shadow mask structure 33, which is taken along a line I—I of FIG. 9. As shown in FIG. 11, an electron shield 40 is connected with the internal magnetic shield 30.

When a cathode ray tube is operated, electron beams are emitted from an electron gun as indicated with arrows 'i' and 'j' in FIG. 11, and temperature inside the cathode ray tube begins to rise. Since the electron beams scan 110% of the effective area of the shadow mask 36, about 5% of the excessive electron beams for each side will hit the electron shield 40 at both ends (arrow 'i'). Therefore, electron beams will hit the electron shield 40 and the shadow mask 36 just after the cathode ray tube starts operating.

Since the electron shield 40 is connected with the internal magnetic shield 30 by welding, the temperature of the internal magnetic shield 30 is raised when electron beams hit the electron shield 40. The temperature rise of the internal magnetic shield 30 causes a temperature rise of the support-adjusting members 37 that are connected with the internal magnetic shield 30 by welding. At this stage, the temperature of short frames 35 does not rise as much as the temperature of the support-adjusting members 37. FIG. 7A can be considered with respect to the situation. The area from the left end to the time t1 indicates that the temperature of the support-adjusting members 37 is higher than the temperature of the short frames 35.

Figure 12A:
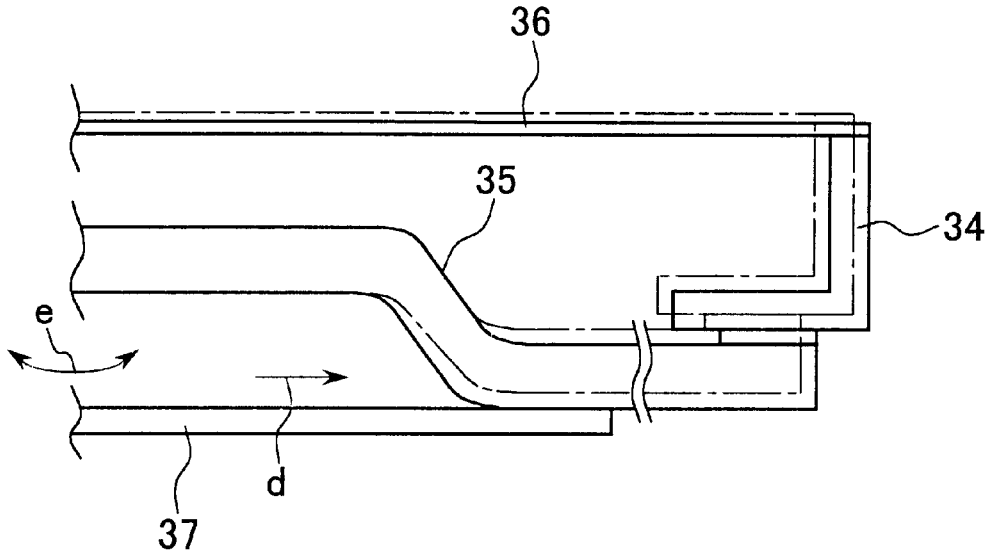
FIG. 12A illustrates the displacement of a frame during an operation of a cathode ray tube before the time t1 of FIG. 7.

FIG. 12A shows the displacement of the short frames 35 when the temperature of the support-adjusting members 37 is higher than that of the short frames 35. In FIG. 12A, the thermal expansion coefficient of the short frames 35 is required to be equal to that of the support-adjusting members 37 (the same condition should be applied to FIG. 12B).

The temperature of the support-adjusting members 37 is higher than that of the short frames 35. Therefore, if the support-adjusting members 37 were not adhered to the short frames 35, the support-adjusting members 37 would be stretched more than the corresponding short frames 35 as a result of thermal expansion.

Actually, since the support-adjusting members 37 are adhered to the short frames 35, the support-adjusting members 37 applies force to the short frames 35 in a direction indicated by an arrow 'd' to stretch the short frames 35. The stretched short frames 35 are bent to form recesses as indicated by an arrow 'e', and the shadow mask 36 is displaced to approach the phosphor surface (as shown by a dashed line in FIG. 12A). Thus, the q-value is decreased.

While a total of about 10% of electron beams hit on the both sides of the electron shield 40, most of the electron beams hit on the shadow mask 36. As a result, the temperature of the shadow mask 36 is increased, the amount of heat of the shadow mask 36 shifts to the long frames 34 and further to the short frames 35. Therefore, as shown in FIG. 7A, a rise in temperature of the short frames 35 lags behind the temperature rise of the support-adjusting members 37.

Since heat shifts continuously from the long frames 34 to the short frames 35, the temperature of the short flames 35 continues to rise even after the temperature of the short frames 35 becomes equal to that of the support-adjusting members 37 at the time t1. The reason is that the amount of heat conducted from the long frames 34 to the short frames 35 is greater than the amount of heat conducted to the support-adjusting members 37 through the electron shield 40 and the internal magnetic shield 30. As shown in FIG. 7A, the temperature of the short frames 35 rises continuously after the time t1 until it is stabilized at a predetermined temperature.

As a result of the temperature rise of the short frames 35, the amount of heat of the short frames 35 will shift to the support-adjusting members 37 as well. In this case, the temperature of the support-adjusting members 37 becomes higher than that of the internal magnetic shield 30 that is connected thereto, so that the amount of heat of the support-adjusting members 37 will shift to the internal magnetic shield 30. Since the internal magnetic shield 30 has a large surface area as shown in FIG. 8, it functions as a radiating plate so as to suppress temperature rise in the support-adjusting member 37.

After the time t1 at which the temperature of the support-adjusting members 37 is equalized with that of the short frames 35, the temperature of the short frames 35 continues to rise, while the temperature rise of the support-adjusting members 37 stops and keeps its stability at a predetermined temperature. Therefore, after the time t1, the relationship between the temperatures of the short frames 35 and the support-adjusting members 37 is reversed. That is, the temperature of the short frames 35 becomes higher than that of the support-adjusting members 37 and stabilized at the temperature.

Figure 12B:
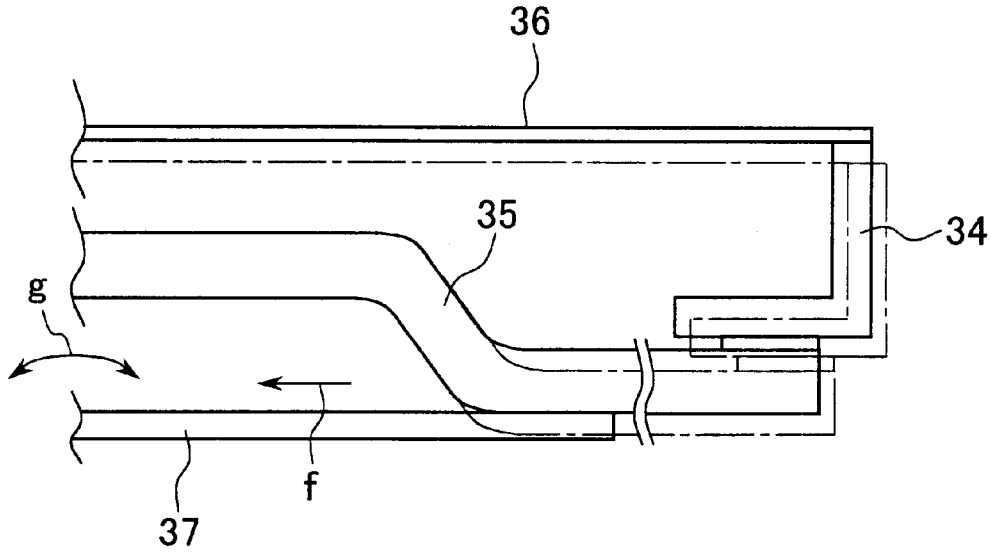
FIG. 12B illustrates the displacement of a frame during an operation of a cathode ray tube after the time t1 of FIG. 7.

FIG. 12B shows the displacement of short frames 35 after the time t1 of FIG. 7A, in which the temperature of the short frames 35 is higher than that of the support-adjusting members 37. If the support-adjusting members 37 were not adhered to the short frames 35, the short frames 35 would be stretched more due to the thermal expansion than the corresponding support-adjusting members 37, since the temperature of the short frames 35 is higher than that of the support-adjusting members 37.

Actually, since the support-adjusting members 37 are adhered to the short frames 35, the support-adjusting members 37 applies force to the short frames 35 in a direction indicated by an arrow 'f' to compress the short frames 35. The compressed short frames 35 are bent to a convex form as indicated by an arrow 'g', and the shadow mask 36 is displaced to recede from the phosphor surface (as shown by a dashed line in FIG. 12B). Thus, the q-value is increased.

If the support-adjusting members 37 in FIG. 12B has a thermal expansion coefficient that is sufficiently higher than that of the short frames 35, the support-adjusting members 37 will apply force to the short frames 35 so as to stretch the short frame 35 (in a direction 'd') as in FIG. 12A. Therefore, each of the short frames 35 is bent to make a recess as shown in an arrow 'e', and the shadow mask 36 is displaced to approach the phosphor surface so as to decrease the displacement in the axial direction.

That is, by making the thermal expansion coefficient of the support-adjusting members 37 to be higher than that of the short frames 35, plastic deformation of the shadow mask in a high temperature region can be prevented in a production process such as a frit-sealing step. In addition, during an operation of a cathode ray tube, this can suppress displacement in the axial direction, which is caused by the difference in temperatures between the short frames 35 and the support-adjusting members 37. In this case, the support-adjusting members 37 are preferred to have a thermal expansion coefficient at least 1.2 times that of the short frames 35. For example, when the support-adjusting members 37 are made of SUS 304 having a thermal expansion coefficient of $180\times10^{-7}/°$ C., the short frames 35 will be made of chrome molybdenum steel having a thermal expansion coefficient of $120\times10^{-7}/°$ C.

When the thermal expansion coefficient of the support-adjusting members 37 is equal to that of the short frames 35, displacement in the axial direction will occur due to the difference in temperatures between the short frames 35 and the support-adjusting members 37 as mentioned above. Such displacement cannot be suppressed sufficiently when the difference in the thermal expansion coefficient is small.

However, even in such a case, it is possible to improve the rigidity of the short frames 35. Therefore, displacement of the shadow mask in the axial direction can be suppressed at a time of impact of electron beams, when compared to a configuration having no support-adjusting members 37.

Fifth Embodiment

In the previous embodiments, the thermal expansion coefficient of the support-adjusting members 37 is determined to be higher than that of the short frames 35 in order to displace the shadow mask 36 to approach the phosphor surface at a time of an operation of a cathode ray tube. Alternatively, the support-adjusting members 37 can have a smaller spring constant in the longitudinal direction. As a result, force 'f' of the support-adjusting members 37 (FIG. 12B) to compress the short frames 35 can be relaxed, and thus, displacement of the shadow mask 36 in the axial direction can be decreased.

Figure 13A:
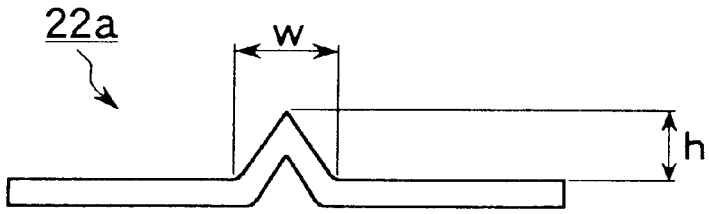
FIG. 13A is a side view of a support-adjusting member in one embodiment of the present invention, in which a protrusion is formed to decrease a spring constant.
Figure 13B:
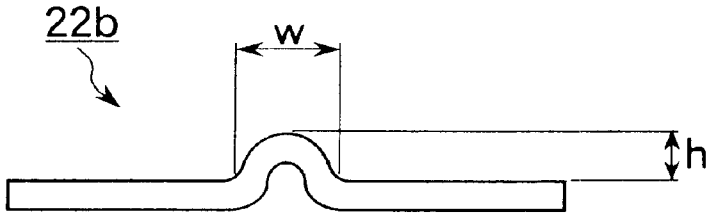
FIG. 13B is a side view of a support-adjusting member in another embodiment of the present invention, in which a protrusion is formed to decrease a spring constant.
Figure 13C:
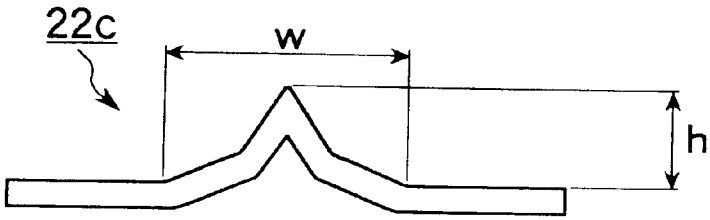
FIG. 13C is a side view of a support-adjusting member in a third embodiment of the present invention, in which a protrusion is formed to decrease a spring constant.

FIGS. 13A–13C are side views of a support-adjusting member according to a fifth embodiment, and each support-adjusting member has a small spring constant. Support-adjusting members 22*a*–22*c* have protrusions for decreasing spring constant. Each protrusion is formed by bending the support-adjusting member substantially at its center when viewed from the side. The support-adjusting member 22*a* of FIG. 13A has a protrusion of a reversed V-shape when viewed from the side. The support-adjusting member 22*b* has a protrusion of reversed-U shape or a semicircular shape when viewed from the side. The support-adjusting member 22*c* of FIG. 13C has a protrusion of FIG. 13A and the support-adjusting member 22*c* is bent further.

To use the spring effect of the respective support-adjusting members and to relax force applied to the short frames 35 in the compressing direction, the protrusion in any of FIGS. 13A–13C is preferred to have a width 'w' ranging from 5 mm to 50 mm, and a height 'h' ranging from 5 mm to 50 mm. It is preferable that the spring constant of each support-adjusting member in the longitudinal direction is $1.47\times10^4$ N/mm or less. Otherwise, the cross-sectional area of each support-adjusting member can be decreased for a decreasing the spring constant.

Sixth Embodiment

Figure 7B:
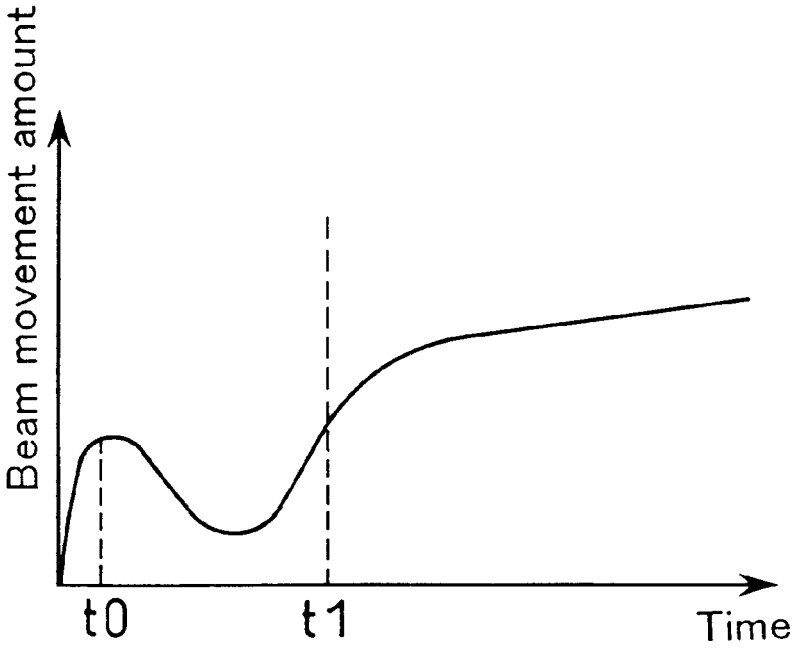
FIG. 7B is a graph to indicate a relationship between time and movement amount of electron beams at a time of operation of a cathode ray tube.

A sixth embodiment is directed to a second method for preventing q-value deviation over time. As mentioned in the fourth embodiment, when the thermal expansion coefficient of the support-adjusting members 37 is substantially equal to that of the short frames 35, the electron beam track changes over time since the shadow mask surface approaches to or recedes from the phosphor surface. FIG. 7B is a graph to indicate a relationship between time and movement amount of electron beams. The change of electron beam tracks will be explained below with a reference to FIG. 7B and also FIG. 7A, indicating a relationship between time and temperature.

By the time t0, the electron beam moves due to frame deformation to cope with thermal expansion of a shadow mask. The thermal expansion is caused by electron beams hitting on the shadow mask at an initial stage of operation. After the time t0, the shadow mask returns to its initial state having no thermal expansion and beam movement amount is decreased for some time, since the support-adjusting members having higher temperature is expanded by heat more than the short frames do.

Subsequently, the temperature rise of the support-adjusting members is slowed down. On the other hand, the temperature of the short frames keeps on rising while maintaining the temperature-rising speed. As a result, the shadow mask is changed in the direction of thermal expansion due to thermal expansion of the short frames, and thus, the beam movement amount is increased. When the temperatures of the support-adjusting members and of the short frames are equalized at the time t1, the electron beam movement amount is equalized to that of the initial time t0. Subsequently, the beam movement amount is increased gradually and it is stabilized in the final stage.

Such a changing electron beam movement amount will make it difficult to adjust a TV set. A purpose of this embodiment is to suppress thermal conduction between a support-adjusting member and an internal magnetic shield in order to prevent temperature difference between the support-adjusting member and a short frame fixing the support-adjusting member, and to stabilize the electron beam movement amount.

Figure 14A:
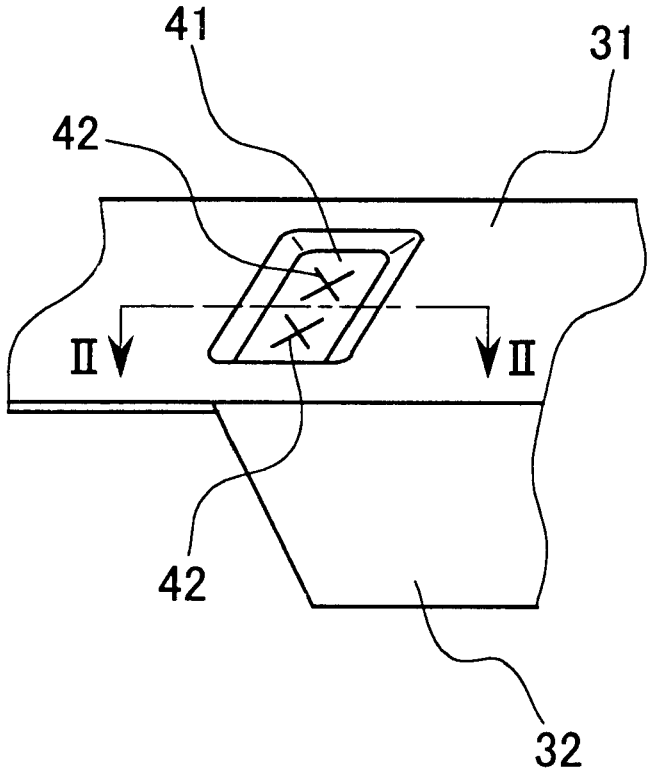
FIG. 14A is a perspective view of Example 1 to illustrate a connection between an internal magnetic shield and a support-adjusting member.
Figure 14B:
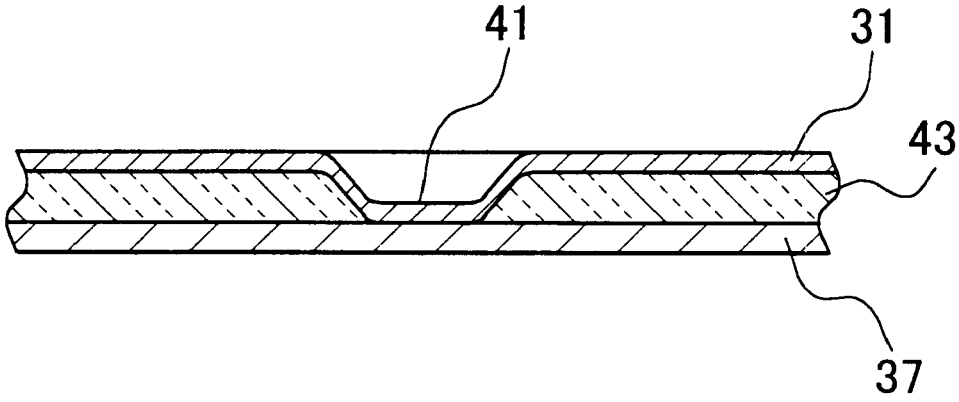
FIG. 14B is a cross-sectional view of FIG. 14A taken along a line II—II.

FIGS. 14A and 14B show an example in which an internal magnetic shield 30 is connected at the flat portions 31 with a support-adjusting members 37 through a protrusion as shown in FIG. 8. FIG. 14A is a perspective view of the flat portion 31, while FIG. 14A is a cross-sectional view of FIG. 14A taken along a line II—II. FIGS. 14A and 14B indicate that a protrusion 41 is formed in the flat portion 31 of the internal magnetic shield 30. Specifically, the protrusion 41 is formed by depressing the flat portion 31 so as to protrude the flat portion 31 toward the support-adjusting member 37. Numeral 42 denotes a welding point, at which the protrusion 41 and the support-adjusting member 37 located below are connected with each other by welding.

As a result, a gap is formed between the lower surface of the flat portion 31 and the upper surface of the support-adjusting member 37 as shown in FIG. 14B. This gap is filled with a low thermal-conductive member 43 having a thermal conductive coefficient lower than that of the internal magnetic shield 30 or the support-adjusting member 37. When the internal magnetic shield 30 and the support-adjusting member 37 are made of a ferrous material, the low thermal-conductive member 43 is made of SUS 304 or the like.

Since the example shown in FIGS. 14A and 14B is effective in suppressing thermal conduction between the flat portion 31 and the support-adjusting member 37, thermal conduction described in the fourth embodiment with a reference to FIG. 11 can be blocked. FIG. 11 shows a thermal conduction to a support-adjusting member 37 through an electron shield 40 and a internal magnetic shield 30. Therefore, a temperature rise in the support-adjusting member 37 is caused substantially by heat conducted from the short frames 35.

Since the suppression of thermal conductivity between the flat portion 31 and the support-adjusting member 37 suppresses thermal conductivity from the support-adjusting member 37 to the flat portion 31, the heat radiation effect of the internal magnetic shield 30, which is described in the fourth embodiment, can be suppressed as well.

Figure 17A:
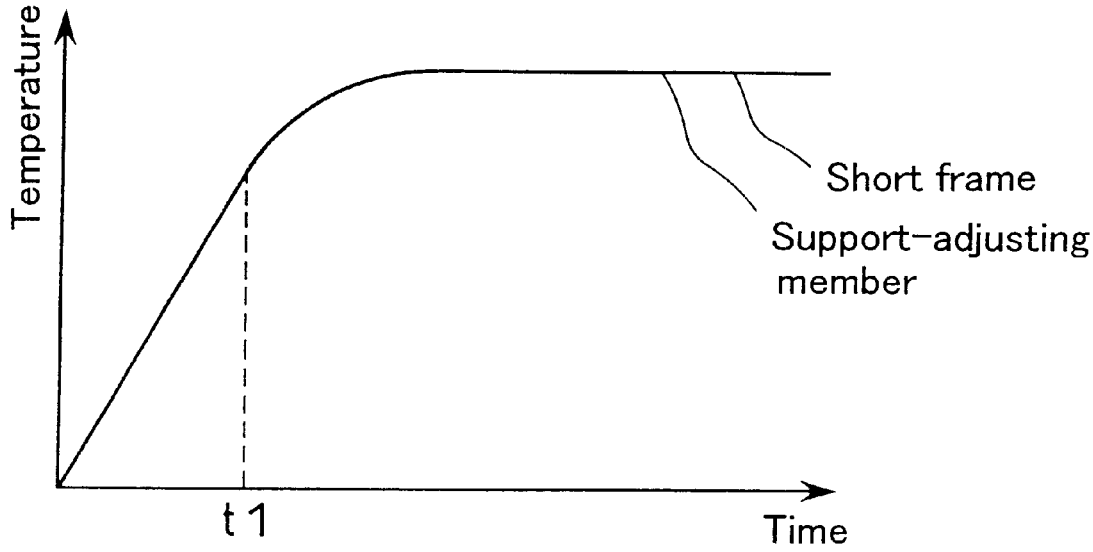
FIG. 17A is a graph to show a relationship between time and movement amount of electron beams concerning a frame and a support-adjusting member at a time of an operation of a cathode ray tube in a sixth embodiment of the present invention.
Figure 17B:
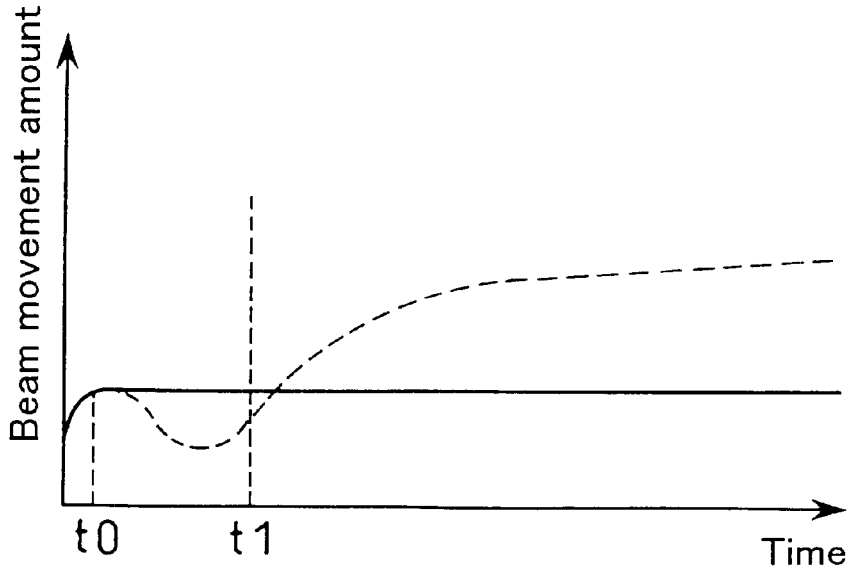
FIG. 17B is a graph to show a relationship between time and movement amount of an electron beam at a time of an operation of a cathode ray tube in the sixth embodiment of the present invention.

FIG. 17A is a graph to indicate a relationship between time and temperature concerning a frame and a support-adjusting member during an operation of a cathode ray tube according to this embodiment. FIG. 17B indicates a relationship between time and electron beam movement amount during an operation of a cathode ray tube according to this embodiment. A broken curve is described in FIG. 17B for facilitating comparison, and it corresponds to the relationship between the time and electron beam movement shown in FIG. 7B.

As indicated in FIG. 17A, the temperatures of the short frames 35 and of the support-adjusting members 37 rise at a same rate after an operation of the cathode ray tube, and the temperatures of the short frames 35 and of the support-adjusting members 37 are stabilized at an identical level after the time t1. As a result, electron beam movement amount will be stabilized at a certain value after the time t0 as shown in FIG. 17B.

As shown in FIG. 14B, a contact area between the flat portion 31 and the support-adjusting member 37 is equal to a connection area at the protrusion 41. A smaller contact area is helpful in suppressing thermal conduction more efficiently between the flat portion 31 and the support-adjusting member 37. Therefore, the contact area is preferred to be 25% or less of one surface of the support-adjusting member 37, and more preferably, 5% or less.

Figure 15A:
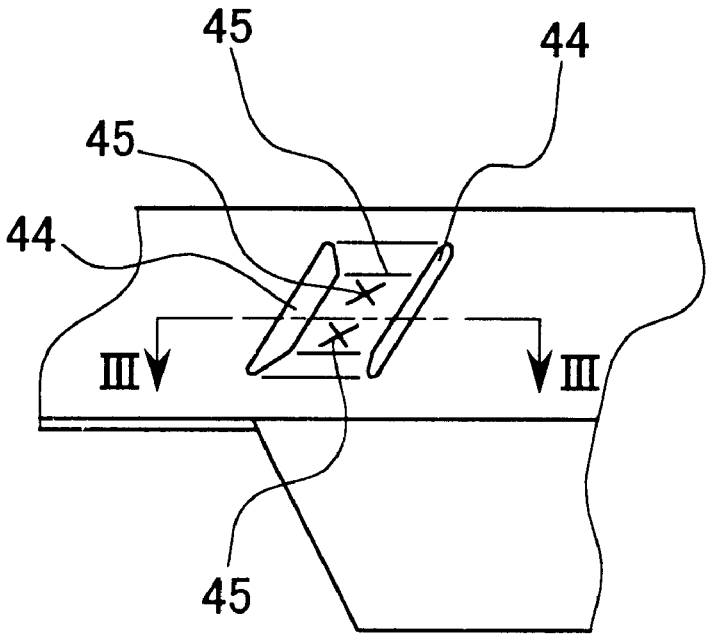
FIG. 15A is a perspective view of Example 2 to illustrate a connection between an internal magnetic shield and a support-adjusting member.
Figure 15B:
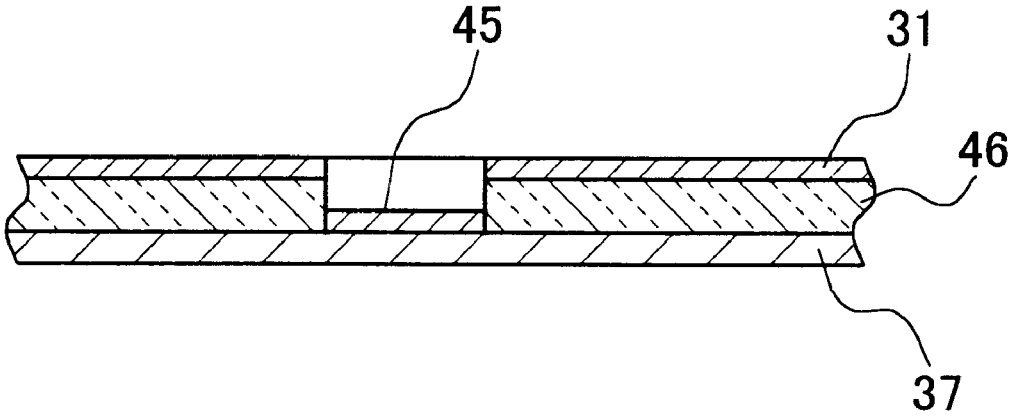
FIG. 15B is a cross-sectional view of FIG. 15A taken along a line III—III.

FIGS. 15A and 15B show another example in which a flat portion 31 of an internal magnetic shield 30 of FIG. 8 is connected with a support-adjusting member 37 through a protrusion. FIG. 15A is perspective view of the flat portion 31. FIG. 15B is a cross-sectional view of FIG. 15A taken along line III—III. In FIGS. 15A and 15B, a protrusion 45 is formed in the flat portion 31 of the internal magnetic shield 30. Specifically, the protrusion 45 is formed by depressing a part between slits 44 and by protruding the flat portion 31 toward the support-adjusting member 37. Numeral 45 denotes a welding point, at which the protrusion 45 and support-adjusting member 37 below the protrusion 45 are connected with each other by welding.

In this example, there exists a low thermal-conductive member 46 between the flat portion 31 and the support-adjusting member 37. This example is the same as the above-mentioned example in the materials of the low thermal-conductive member and in the proportion of the contact area at the protrusion 45. That is, this example is identical to the above-mentioned example in FIGS. 14A and 14B except in the method of forming a protrusion, and similar effects can be obtained.

Figure 16A:
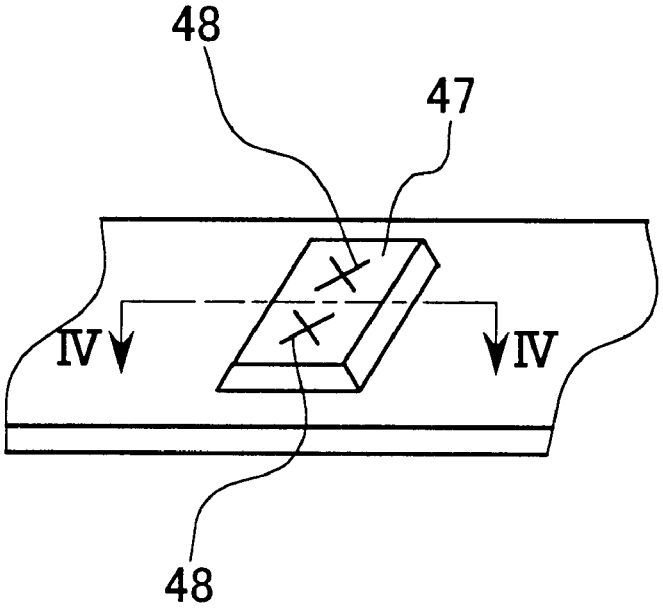
FIG. 16A is a perspective view of Example 3 to illustrate a connection between an internal magnetic shield and a support-adjusting member.
Figure 16B:
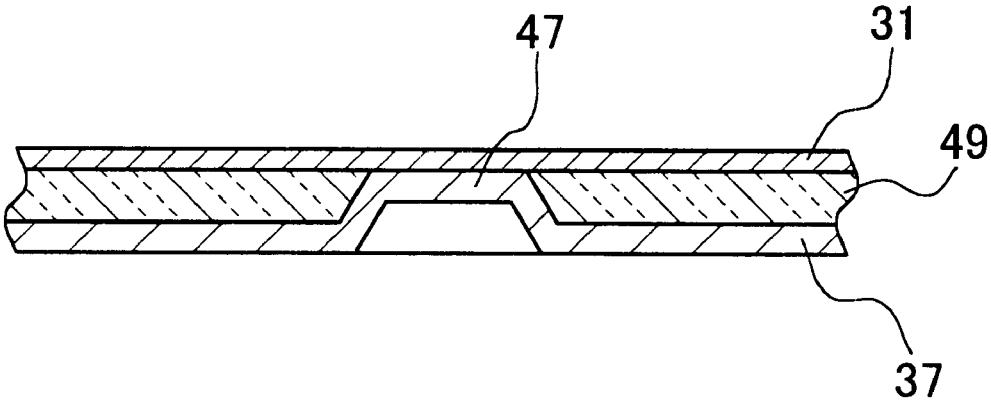
FIG. 16B is a cross-sectional view of FIG. 16A taken along a line IV—IV.

FIGS. 16A and 16B show a third example provided by connecting a flat portion 31 and a support-adjusting member 37 through a protrusion. FIG. 16A is a perspective view of the support-adjusting member 37, while FIG. 16B is a cross-sectional view of FIG. 16A taken along line IV—IV.

In FIGS. 16A and 16B, a protrusion 47 is formed in the support-adjusting member 37. Specifically, the protrusion 47 is formed by depressing the support-adjusting member 37 to form a recess when viewed from the backside, so that the support-adjusting member 37 protrudes toward the flat portion 31. Numeral 48 denotes a welding point, at which the protrusion 47 and the flat portion 31 above the protrusion 47 are connected with each other by welding.

In this example, there exists a low thermal-conductive member 49 between the flat portion 31 and the support-adjusting member 37. This example is common to the above-mentioned example in the materials of the low thermal-conductive member 49 and in the proportion of the contact area at the protrusion 47. That is, this example is identical to the prior example shown in FIGS. 14A and 14B except in the method of forming a protrusion, and similar effects can be obtained.

In the examples shown in FIGS. 14–16, the flat portion 31 and the support-adjusting member 37 are connected with each other through a protrusion. Alternatively, the flat portion 31 and the support-adjusting member 37 can be connected with each other through an insulating material such as ceramics. Such a configuration cannot provide an easy and reliable connection when compared to the examples shown in FIGS. 13–15. However, the insulation effectiveness is improved since the flat portion 31 and the support-adjusting member 37 will not be contacted directly with each other. The low thermal conductive member 49 between the flat portion 31 and the support-adjusting member 37 can be omitted when the contact area between these two components is small so that sufficient thermal insulating effects can be provided.

FIG. 6 shows an embodiment in which a support-adjusting member 22 having a high expanding property is adhered to a backside of the frame 14. A similar effect can be obtained if a surface 14*b* of the frame 14 is adhered with a less expanding support-adjusting member having a thermal expansion coefficient smaller than that of the frame 14. In such a case, the less expanding support-adjusting member can be made of, for example, a 36% Ni—Fe alloy.

The support-adjusting member in this embodiment is adhered to a frame 14 shown in FIG. 2. Similar effects can be obtained even if support-adjusting member is adhered to a frame 18 shown in FIG. 3.

When a shadow mask is stretched uniaxially, a transverse clearance will be formed. As a result, geomagnetic flux can pass easily, and thus, electron beams move and the movement causes color displacement. Since crank-shaped steps are formed in the respective embodiments, the transverse clearance can be blocked with a ferrous material, so that a magnetic shield effect can be obtained.

In the embodiments, spring members 12 are attached to the frames 14 and 18 through spring-attaching members 11. Alternatively, the spring members 12 can be attached directly to the frames 14, 18 or to the support-adjusting members 21. In this case, the spring members 12 can be attached at or outside of the recesses formed as crank-shaped steps. This configuration requires no spring-attaching members.

In the above embodiments, the frames 14 are bent at positions adhered to the frames 7. Alternatively, the frames 14 can be adhered to the frames 7 without bending.

In the above-mentioned embodiments, the crank-shaped steps formed in the frames 14 and 18 are substantially U-shape. The shape is not limited thereto, but it can be a reversed V-shape (angular) or a reversed U-shape (semicircular) as in the support-adjusting member shown in FIGS. 13A–13C.

In any of the above-mentioned embodiments, the shadow mask structure is bridged with four spring members. Similar effects can be obtained by bridging the shadow mask structure with three spring members.

In any of the above-mentioned embodiments, a shadow mask is adhered to upper surfaces of top and bottom frames as plate members. The shadow mask is not necessarily adhered to the upper surfaces of the frames but it can be adhered to any upper parts of the frames. For example, a shadow mask can be bent to provide a bent part adhered to upper parts of sides of the frames.

INDUSTRIAL APPLICABILITY

As mentioned above, a cathode ray tube of the present invention comprises a shadow mask structure composed of a pair of frames having crank-shaped steps. This configuration is effective in decreasing an inner force moment of the shadow mask structure. In addition to that, even when the shadow mask is expanded by heat provided by the impact of electron beams, the shadow mask can be prevented from being displaced in the axial direction, and q-value deviation can be suppressed as well. Moreover, since the crank-shaped steps in the supporters enable blocking of a transverse clearance with a ferrous material, magnetic properties can be improved. Therefore, a shadow mask type cathode ray tube according to the present invention can be used for a TV receiver, a computer display or the like.

What is claimed is:

1. A cathode ray tube comprising:

a pair of plate members facing each other, a pair of supporters adhered to the respective plate members so as to support the plate members, and a shadow mask adhered to the respective plate members while being applied with tensile force, wherein the supporters comprise crank-shaped steps formed to protrude toward the shadow mask.

2. The cathode ray tube according to claim 1, wherein the supporters have portions extended from respective ends of the plate members in the longitudinal direction to the insides of the plate members, and the ends of the extended portions are adhered to the plate members so that the support members are adhered to the plate members at insides of the plate members in the longitudinal direction.

3. The cathode ray tube according to claim 1, wherein the supporters comprise spring-attaching members adhered to recesses at the crank-shaped steps so as to support the supporters, spring members are adhered to the spring-attaching members, and attaching holes are formed in the spring members for accepting attaching pins, and the attaching holes have central points located opposing the shadow mask with respect to the supporters adhered to the plate members.

4. The cathode ray tube according to claim 1, wherein the supporters comprise spring members adhered either at or outside the recesses at the crank-shaped steps so as to support the supporters, attaching holes are formed in the spring members for accepting attaching pins, and the attaching holes have central points located opposing the shadow mask with respect to the supporters adhered to the plate members.

5. The cathode ray tube according to claim 1, wherein the crank-shaped steps have straight parts in the longitudinal direction of the supporters.

6. The cathode ray tube according to claim 1, wherein the crank-shaped steps have central axes at parts displaced toward the shadow mask, and the central axes are located above the shadow mask.

7. The cathode ray tube according to claim 1, wherein the crank-shaped steps have circular bent parts, and an inner radius of curvature at the circular bent parts is at least 20 mm.

8. The cathode ray tube according to claim 1, wherein support-adjusting members are adhered through the recesses at the crank-shaped steps, and the support-adjusting members are located facing the supporters.

9. The cathode ray tube according to claim 8, wherein the support-adjusting members comprise protrusions formed to lower a spring constant of the support-adjusting members in the longitudinal direction.

10. The cathode ray tube according to claim 8, wherein the spring constant of the support-adjusting members in the longitudinal direction is at most $1.47\times10^4$ N/mm.

11. The cathode ray tube according to claim 8, wherein the support-adjusting members have a thermal expansion coefficient that is higher than a thermal expansion coefficient of the supporters.

12. The cathode ray tube according to claim 11, wherein the support-adjusting members have a thermal expansion coefficient at least 1.2 times a thermal expansion coefficient of the supporters.

13. The cathode ray tube according to claim 8, wherein an internal magnetic shield is adhered to the support-adjusting members through an insulating material.

14. The cathode ray tube according to claim 8, wherein an internal magnetic shield is adhered to the support-adjusting members, and an area that the internal magnetic shield is contacted with the support-adjusting members is at most 25% of one surface of each of the support-adjusting members.

15. The cathode ray tube according to claim 14, wherein the area that the internal magnetic shield is contacted with the support-adjusting members is at most 5% of one surface of each of the support-adjusting members.

16. The cathode ray tube according to claim 14, wherein an additional member is provided between the internal magnetic shield and the support-adjusting members, and the additional member has a thermal conductivity that is lower than a thermal conductivity of the internal magnetic shield or of the support-adjusting members.

17. The cathode ray tube according to claim 16, wherein the material of the additional member having a low thermal conductivity is SUS 304.

18. The cathode ray tube according to claim 14, wherein the internal magnetic shield is connected with the support-adjusting members through a protrusion formed in at least either the internal magnetic shield or the support-adjusting members, and the contact area is equal to the connection area at the protrusion.

19. The cathode ray tube according to claim 1, wherein support-adjusting members having a thermal expansion coefficient lower than a thermal expansion coefficient of the supporters are adhered to surfaces of the crank-shaped steps that are displaced toward the shadow mask.

* * * * *